US007942298B2

(12) United States Patent
Kandasamy

(10) Patent No.: US 7,942,298 B2
(45) Date of Patent: May 17, 2011

(54) PAPER PROCESSING TOOL WITH FORCE REDUCING DRIVE ARRANGEMENT

(75) Inventor: Balaji Kandasamy, Naperville, IL (US)

(73) Assignee: ACCO Brands USA LLC, Lincolnshire, IL (US)

( * ) Notice: Subject to any disclaimer, the term of this patent is extended or adjusted under 35 U.S.C. 154(b) by 273 days.

(21) Appl. No.: 12/351,287

(22) Filed: Jan. 9, 2009

(65) Prior Publication Data

US 2009/0120992 A1 May 14, 2009

Related U.S. Application Data

(63) Continuation-in-part of application No. 11/530,322, filed on Sep. 8, 2006, now Pat. No. 7,584,878.

(60) Provisional application No. 60/715,254, filed on Sep. 8, 2005, provisional application No. 61/019,961, filed on Jan. 9, 2008.

(51) Int. Cl.
*B25C 5/06* (2006.01)

(52) U.S. Cl. ..... 227/120; 227/76; 227/134

(58) Field of Classification Search ..... 227/120, 227/132, 134, 131, 64, 76
See application file for complete search history.

(56) References Cited

U.S. PATENT DOCUMENTS

| | | | |
|---|---|---|---|
| 41,861 | A | 3/1864 | Renfrew |
| 332,666 | A | 12/1885 | Laney |
| 383,200 | A | 5/1888 | Weber et al. |
| 1,054,132 | A | 2/1913 | Miner |
| 1,615,020 | A | 1/1927 | Loehr |
| 1,728,475 | A | 9/1929 | Cavill |
| 1,962,874 | A | 6/1934 | Fridolin |
| 1,998,328 | A | 4/1935 | McKinnie |
| 2,132,047 | A | 10/1938 | Rix |
| 2,278,288 | A | 3/1942 | Sadler |
| 2,326,540 | A | 8/1943 | Krantz |
| 2,382,523 | A | 8/1945 | Unger |
| 2,474,344 | A | 6/1949 | Carpenter |
| 2,482,218 | A | 9/1949 | Segal |
| 2,671,215 | A | 3/1954 | Abrams |
| 2,814,346 | A | 11/1957 | Jauss |
| 2,962,178 | A | 11/1960 | Exline |
| 3,087,366 | A | 4/1963 | Stults |
| 3,120,778 | A | 2/1964 | Brye |
| 3,181,408 | A | 5/1965 | Richards |
| 3,263,548 | A | 8/1966 | Kobler et al. |
| 3,472,101 | A | 10/1969 | Tanaka |
| 3,590,484 | A | 7/1971 | Walsh |

(Continued)

FOREIGN PATENT DOCUMENTS

| | | | |
|---|---|---|---|
| AU | 2007100602 | A4 | 8/2007 |

(Continued)

*Primary Examiner* — Scott A. Smith
(74) *Attorney, Agent, or Firm* — Michael Best & Friedrich LLP

(57) ABSTRACT

A stapler includes a base member, a magazine for receiving a plurality of staples, and a drive member including a driver blade movable relative to the magazine for ejecting staples from the magazine one at a time. The stapler further includes an input member pivotally coupled to the drive member. The input member is configured to receive an input force and transmit the input force to the drive member for driving movement of the drive member relative to the magazine. One of the drive member and the input member pivots about a pivot axis that moves relative to the base member along an arcuate path.

19 Claims, 25 Drawing Sheets

U.S. PATENT DOCUMENTS

| | | | |
|---|---|---|---|
| 3,735,655 | A | 5/1973 | Dedona et al. |
| 3,748,936 | A | 7/1973 | Minasy |
| 3,756,625 | A | 9/1973 | Abilgaard et al. |
| 3,793,660 | A | 2/1974 | Sims |
| 3,821,890 | A | 7/1974 | Dewey |
| 3,826,168 | A | 7/1974 | Groswith, III et al. |
| 3,842,650 | A | 10/1974 | Hartmeister |
| 3,921,487 | A | 11/1975 | Otsuka et al. |
| 4,014,493 | A | 3/1977 | Wolfe |
| 4,019,415 | A | 4/1977 | Wich |
| 4,036,088 | A | 7/1977 | Ruskin |
| 4,077,288 | A | 3/1978 | Holland |
| 4,126,260 | A | 11/1978 | Mickelsson |
| 4,166,404 | A | 9/1979 | Almog |
| 4,173,162 | A | 11/1979 | Shaughnessy |
| 4,184,396 | A | 1/1980 | Hafner |
| 4,288,019 | A | 9/1981 | Dahle |
| 4,294,152 | A | 10/1981 | Land |
| 4,301,723 | A | 11/1981 | Borzym |
| 4,466,322 | A | 8/1984 | Mori |
| 4,499,805 | A | 2/1985 | Mori |
| 4,611,520 | A | 9/1986 | Terracciano |
| 4,645,399 | A | 2/1987 | Scharer |
| 4,656,907 | A | 4/1987 | Hymmen |
| 4,664,004 | A | 5/1987 | Randall |
| 4,706,533 | A | 11/1987 | Giulie |
| 4,713,995 | A | 12/1987 | Davi |
| 4,757,733 | A | 7/1988 | Barlow |
| 4,779,785 | A | 10/1988 | Amagaya |
| 4,833,958 | A | 5/1989 | Abildgaard et al. |
| 4,878,608 | A | 11/1989 | Mitsuhashi |
| 4,984,729 | A | 1/1991 | Balma |
| 4,987,811 | A | 1/1991 | Ikarashi et al. |
| 4,993,291 | A | 2/1991 | Sopko |
| 5,007,782 | A | 4/1991 | Groswith, III et al. |
| 5,040,441 | A | 8/1991 | Tamura |
| 5,044,242 | A | 9/1991 | Chiang |
| 5,143,502 | A | 9/1992 | Kaufmann et al. |
| 5,163,350 | A | 11/1992 | Groswith, III et al. |
| 5,174,794 | A | 12/1992 | Brownlee et al. |
| 5,247,863 | A | 9/1993 | Cohen |
| 5,273,387 | A | 12/1993 | Groswith, III et al. |
| 5,335,839 | A | 8/1994 | Fealey |
| 5,356,063 | A | 10/1994 | Perez |
| 5,377,415 | A | 1/1995 | Gibson |
| 5,421,502 | A | 6/1995 | Huang |
| 5,431,519 | A | 7/1995 | Baumann |
| 5,492,261 | A | 2/1996 | Chi |
| 5,494,364 | A | 2/1996 | Murakami et al. |
| 5,497,932 | A | 3/1996 | Brewer et al. |
| 5,639,007 | A | 6/1997 | Nakamura |
| 5,664,473 | A | 9/1997 | Huang |
| 5,664,722 | A | 9/1997 | Marks |
| 5,683,218 | A | 11/1997 | Mori |
| 5,740,712 | A | 4/1998 | Watkins et al. |
| 5,758,813 | A | 6/1998 | Kikuchi et al. |
| 5,765,742 | A | 6/1998 | Marks |
| 5,778,750 | A | 7/1998 | Drzewiecki et al. |
| 5,890,642 | A | 4/1999 | Sato |
| 5,979,736 | A | 11/1999 | Edeholt |
| 6,109,155 | A | 8/2000 | Huang |
| 6,142,355 | A | 11/2000 | Wu |
| 6,145,728 | A | 11/2000 | Marks |
| 6,179,193 | B1 | 1/2001 | Nagai |
| 6,547,119 | B2 | 4/2003 | Huang |
| 6,550,661 | B2 | 4/2003 | Aoki |
| 6,688,199 | B2 | 2/2004 | Godston et al. |
| 6,776,321 | B2 | 8/2004 | Jairam et al. |
| 6,789,593 | B1 | 9/2004 | Aono et al. |
| 6,789,719 | B2 | 9/2004 | Shor |
| 6,918,525 | B2 | 7/2005 | Marks |
| 6,966,479 | B2 | 11/2005 | Tanaka et al. |
| 6,997,092 | B2 | 2/2006 | Lin |
| 7,118,019 | B2 | 10/2006 | Marks |
| 7,124,922 | B2 | 10/2006 | Marks |
| 7,124,924 | B2 | 10/2006 | Marks |
| 7,178,709 | B2 | 2/2007 | Marks |
| 7,216,791 | B1 | 5/2007 | Marks |
| 7,299,960 | B1 | 11/2007 | Marks |
| 7,395,955 | B2 | 7/2008 | Zins et al. |
| 7,584,878 | B2 * | 9/2009 | Kandasamy ..... 227/120 |
| 7,610,838 | B2 | 11/2009 | Kent et al. |
| 2002/0005427 | A1 | 1/2002 | Aoki |
| 2002/0020272 | A1 | 2/2002 | Godston et al. |
| 2003/0010176 | A1 | 1/2003 | Chiang |
| 2003/0047581 | A1 | 3/2003 | Tanaka et al. |
| 2003/0155400 | A1 | 8/2003 | Jairam et al. |
| 2004/0069110 | A1 | 4/2004 | Godston et al. |
| 2005/0229765 | A1 | 10/2005 | Watanabe |
| 2006/0138192 | A1 | 6/2006 | Matsukawa |
| 2007/0044618 | A1 | 3/2007 | Marks |
| 2007/0044623 | A1 | 3/2007 | Marks |
| 2007/0044624 | A1 | 3/2007 | Marks |
| 2007/0057011 | A1 | 3/2007 | Kandasamy et al. |
| 2007/0057012 | A1 | 3/2007 | Kandasamy et al. |
| 2007/0107576 | A1 | 5/2007 | Chen |
| 2007/0125823 | A1 | 6/2007 | Marks |
| 2007/0145094 | A1 | 6/2007 | Chou |
| 2007/0158384 | A1 | 7/2007 | Zins et al. |
| 2007/0169603 | A1 | 7/2007 | Marks |
| 2007/0199424 | A1 | 8/2007 | Marks |
| 2007/0199971 | A1 | 8/2007 | Chen |
| 2007/0221699 | A1 | 9/2007 | Hsu |
| 2007/0227286 | A1 | 10/2007 | Kandasamy |
| 2007/0266836 | A1 | 11/2007 | Marks |
| 2007/0267472 | A1 | 11/2007 | Marks |
| 2008/0236353 | A1 | 10/2008 | Kent et al. |

FOREIGN PATENT DOCUMENTS

| | | | |
|---|---|---|---|
| CH | 252144 | | 9/1948 |
| DE | 1042530 | | 11/1958 |
| EP | 0283676 | | 9/1988 |
| EP | 0385034 | | 9/1990 |
| EP | 0761392 | | 3/1997 |
| FR | 994186 | | 11/1951 |
| JP | 4300198 | | 10/1992 |
| JP | 8155898 | | 6/1996 |
| WO | 2007030712 | | 3/2007 |
| WO | 2007055297 | A1 | 5/2007 |
| WO | 2007055298 | A1 | 5/2007 |
| WO | 2007055398 | A1 | 5/2007 |
| WO | 2007058337 | A1 | 5/2007 |
| WO | 2007087309 | A2 | 8/2007 |

* cited by examiner

PAPER PROCESSING TOOL WITH FORCE REDUCING DRIVE ARRANGEMENT

CROSS-REFERENCE TO RELATED APPLICATIONS

This application is a continuation-in-part of U.S. patent application Ser. No. 11/530,322, filed Sep. 8, 2006, now U.S. Pat. No. 7,584,878, which claims priority to U.S. Provisional Patent Application No. 60/715,254, filed Sep. 8, 2005, the entire contents of both of which are hereby incorporated by reference. This application also claims priority to U.S. Provisional Patent Application No. 61/019,961, filed Jan. 9, 2008, the entire contents of which are hereby incorporated by reference.

BACKGROUND

The present invention relates to drive arrangements for paper processing tools including staplers, which are designed to reduce the effort required to perform an operation upon one or more sheets of paper.

SUMMARY

In one embodiment, the invention provides a stapler including a base member, a magazine for receiving a plurality of staples, and a drive member including a driver blade movable relative to the magazine for ejecting staples from the magazine one at a time. An input member is pivotally coupled to the drive member. The input member is configured to receive an input force and transmit the input force to the drive member for driving movement of the drive member relative to the magazine. Means are provided for pivoting one of the drive member and the input member about a pivot axis such that the pivot axis moves relative to the base member along an arcuate path.

In another embodiment, the invention provides a stapler including a base member, a magazine for receiving a plurality of staples, and a drive member including a driver blade movable relative to the magazine for ejecting staples from the magazine one at a time. An input member is pivotally coupled to the drive member. The input member being configured to receive an input force and transmit the input force to the drive member for driving movement of the drive member relative to the magazine. An auxiliary member is pivotally coupled to the base member and to one of the drive member and the input member, and the other of the drive member and the input member is pivotally coupled to the base member.

In yet another embodiment, the invention provides a paper tool including a base member, a drive member, an input member pivotally coupled to the drive member; and means for pivoting the drive member about a pivot axis such that the pivot axis moves relative to the base member along an arcuate path.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

DETAILED DESCRIPTION

Figure 1:
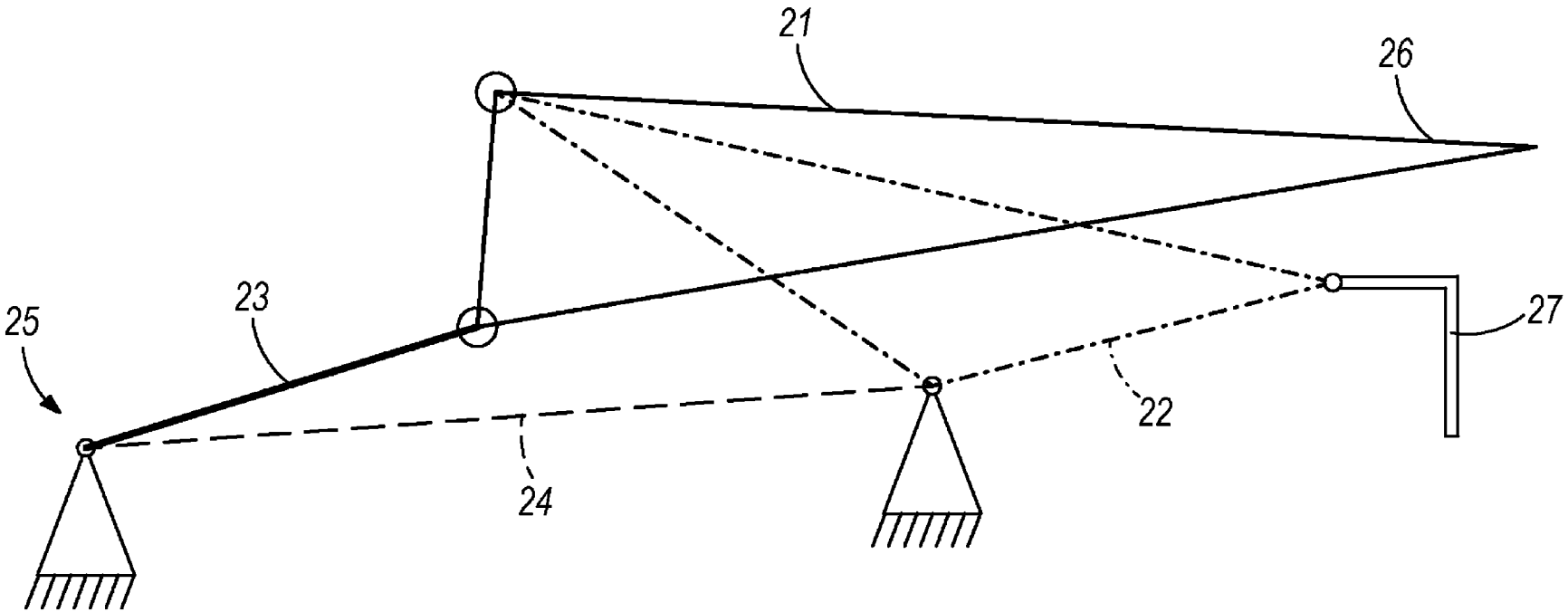
FIG. 1 is a schematic view of a first linkage according to the present invention.
Figure 2:
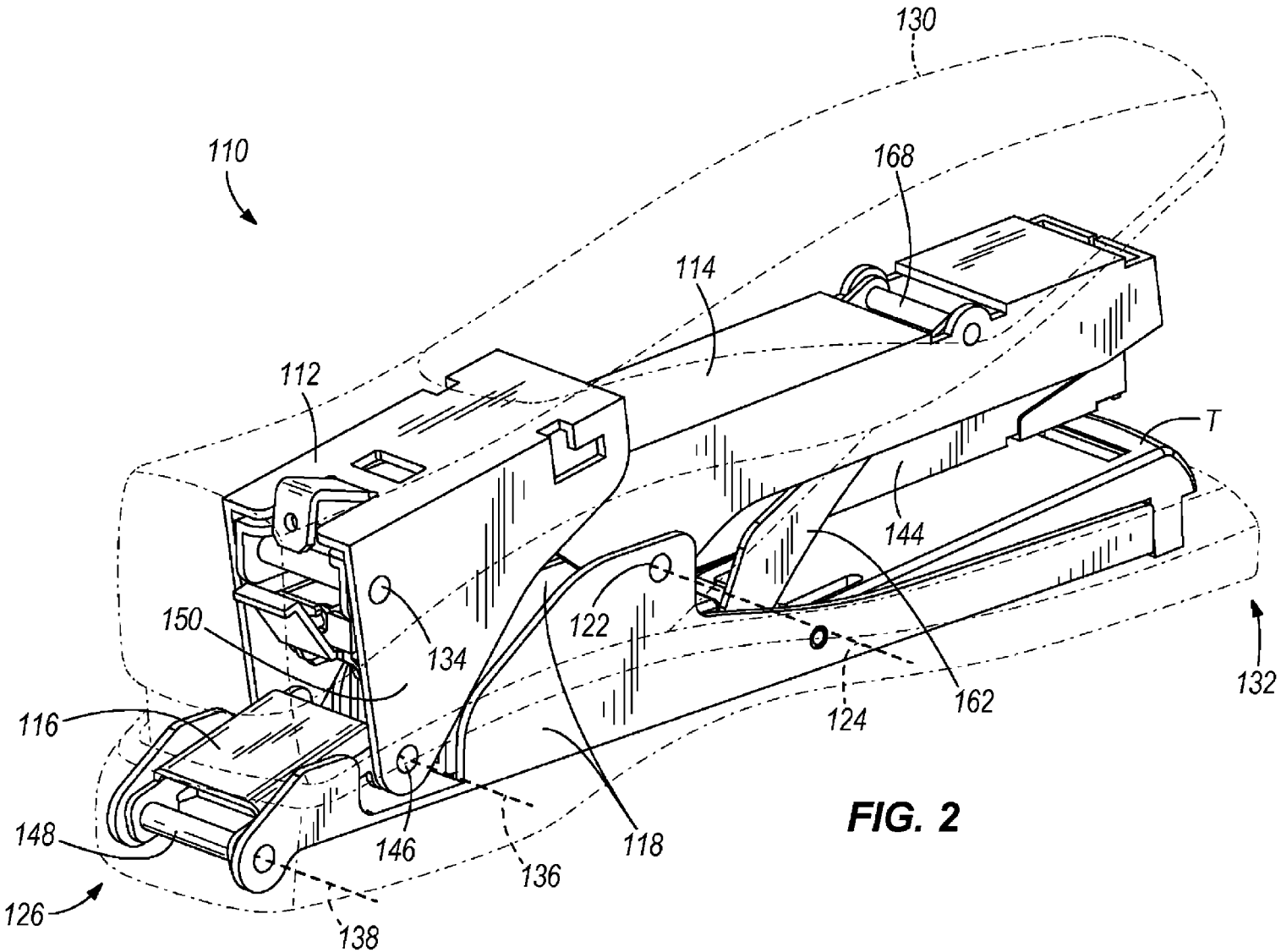
FIG. 2 is a perspective view of a stapler according to a first embodiment, having a drive arrangement consistent with the linkage of FIG. 1.

FIG. 1 is a schematic view of a first linkage. The linkage of FIG. 1 is a four-bar linkage drive arrangement for a paper processing tool. The drive arrangement includes an input member 21 (solid line), a drive member 22 (dash-dot line), an auxiliary member 23 (bold solid line), and a fixed base member 24 (dashed line). The drive member 22 is pivotally coupled to the base member 24. The input member 21 and the drive member 22 are pivotally coupled at a location rearward of the point at which the drive member 22 is coupled to the base member 24. The input member 21 is coupled to the base member 24 through the auxiliary member 23 such that the input member 21 does not have a fixed pivot axis relative to the base member 24. Rather, the pivot axis of the input member 21 relative to the base member 24 is movable along an arcuate path defined by the auxiliary member 23. The auxiliary member 23 is coupled directly to the base member 24 adjacent a rear end 25 of the drive arrangement and has a fixed pivot axis relative to the base member 24.

As shown in FIG. 1, the pivot axis of the auxiliary member 23 on the base member 24 is positioned rearward of the fixed pivot of the drive member 22 and rearward of the non-fixed pivot axis where the input member 21 is coupled to the auxiliary member 23. The auxiliary member 23 (while movable to some extent during operation) extends from its fixed pivot in a direction generally away from the rear end 25 of the drive arrangement and towards the front of the drive arrangement where the handle portion 26 and driver blade 27 are positioned.

Figure 3:
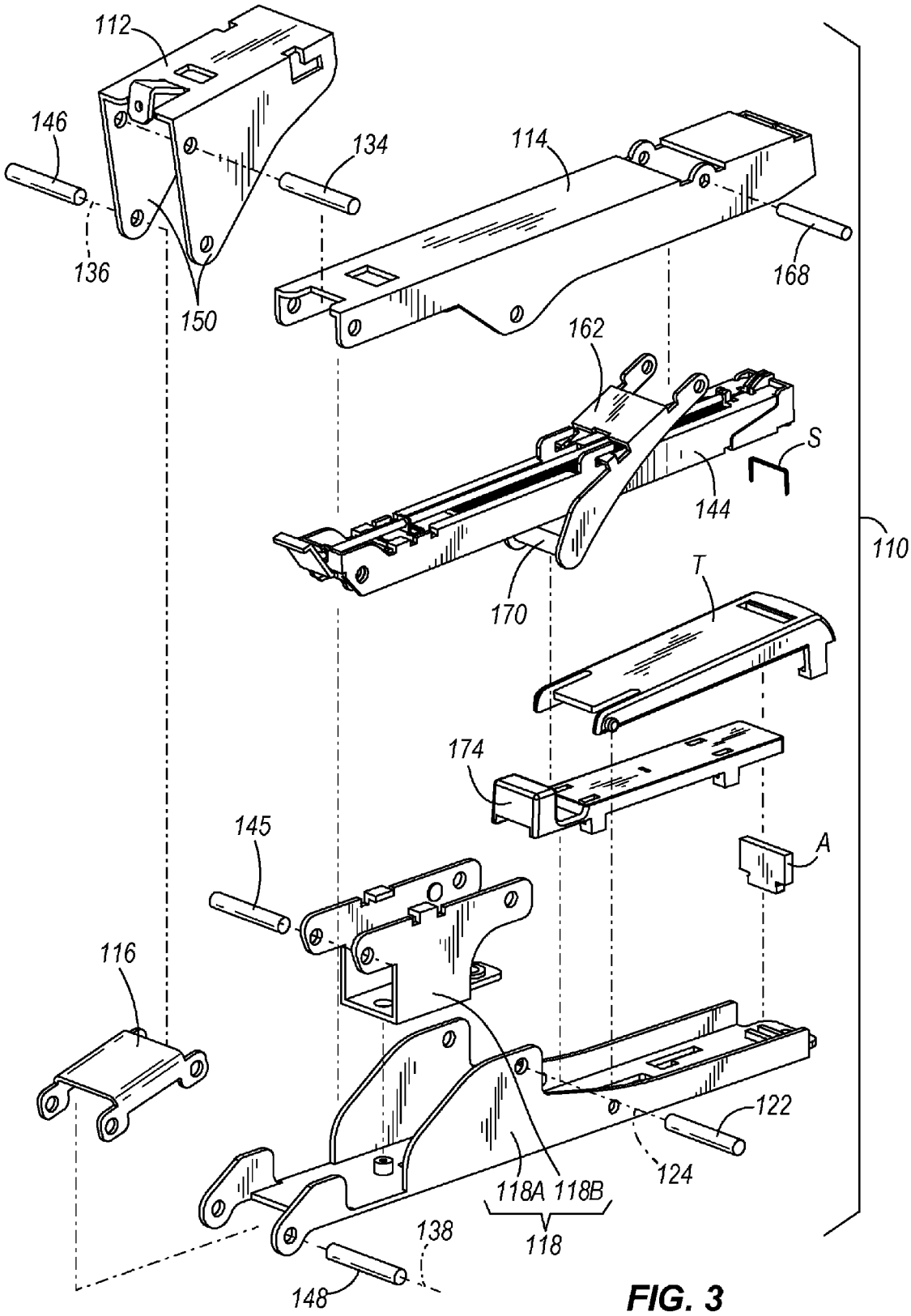
FIG. 3 is an exploded assembly view of the stapler of FIG. 2.

FIGS. 2-6C illustrate a paper tool 110 having a drive arrangement consistent with the linkage of FIG. 1. In the illustrated construction, the paper tool 110 is a stapler. The stapler 110 includes a four-bar linkage drive arrangement including an input member 112, a drive member 114, an auxiliary member 116, and a fixed base member 118. The base member 118 can include two parts 118A, 118B as shown in FIG. 3. The drive member 114 is pivotally coupled to the base member 118 with a pin 122 defining a pivot axis 124 that is fixed relative to the base member 118. The pivot axis 124 of the drive member 114 is located substantially forward of a first or rear end 126 of the stapler 110. In the illustrated construction, the rear end 126 is defined by a fixed pivot location on the base member 118 (e.g., for the auxiliary member 116).

Figure 4C:
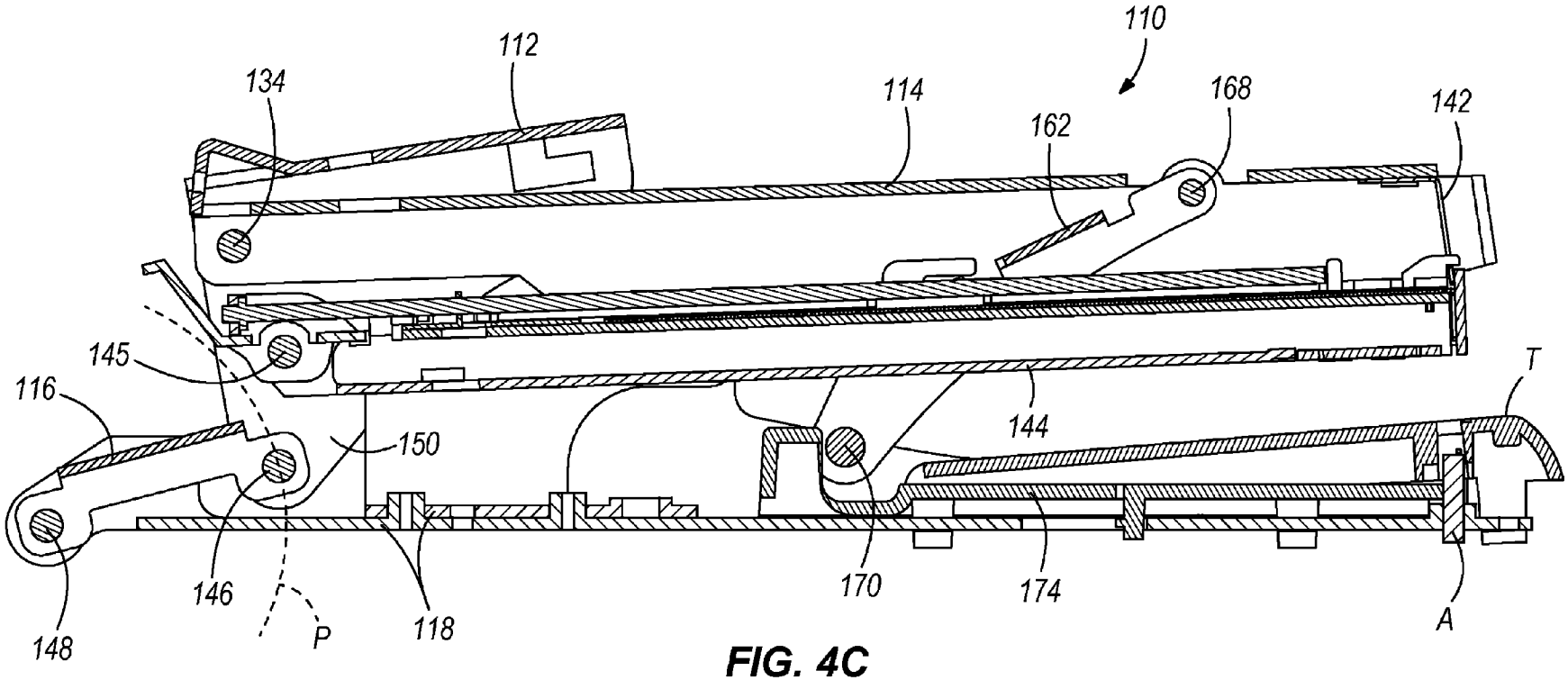
FIG. 4C is a cross-sectional view of the stapler of FIG. 2 in the first condition.
Figure 5A:
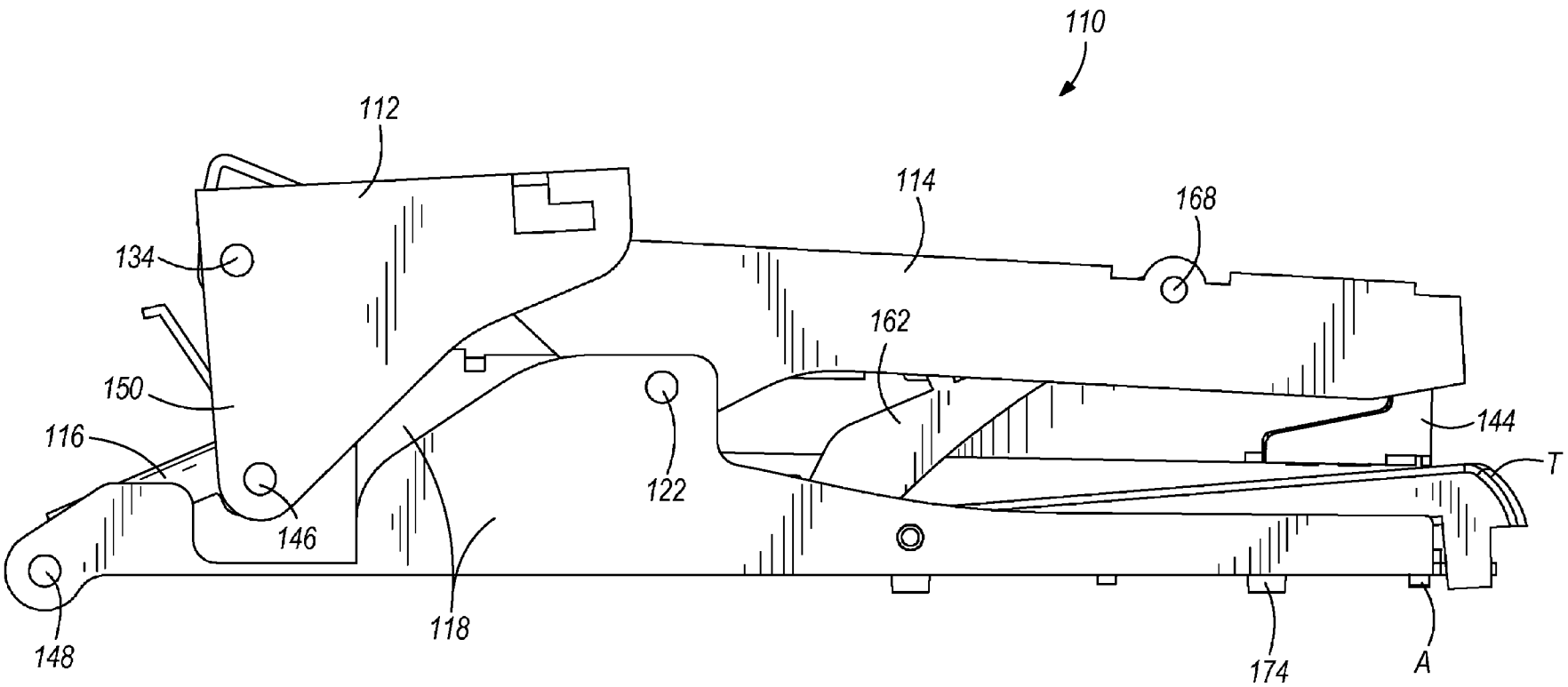
FIG. 5A is a side view of the stapler of FIG. 2 in a second condition.
Figure 5B:
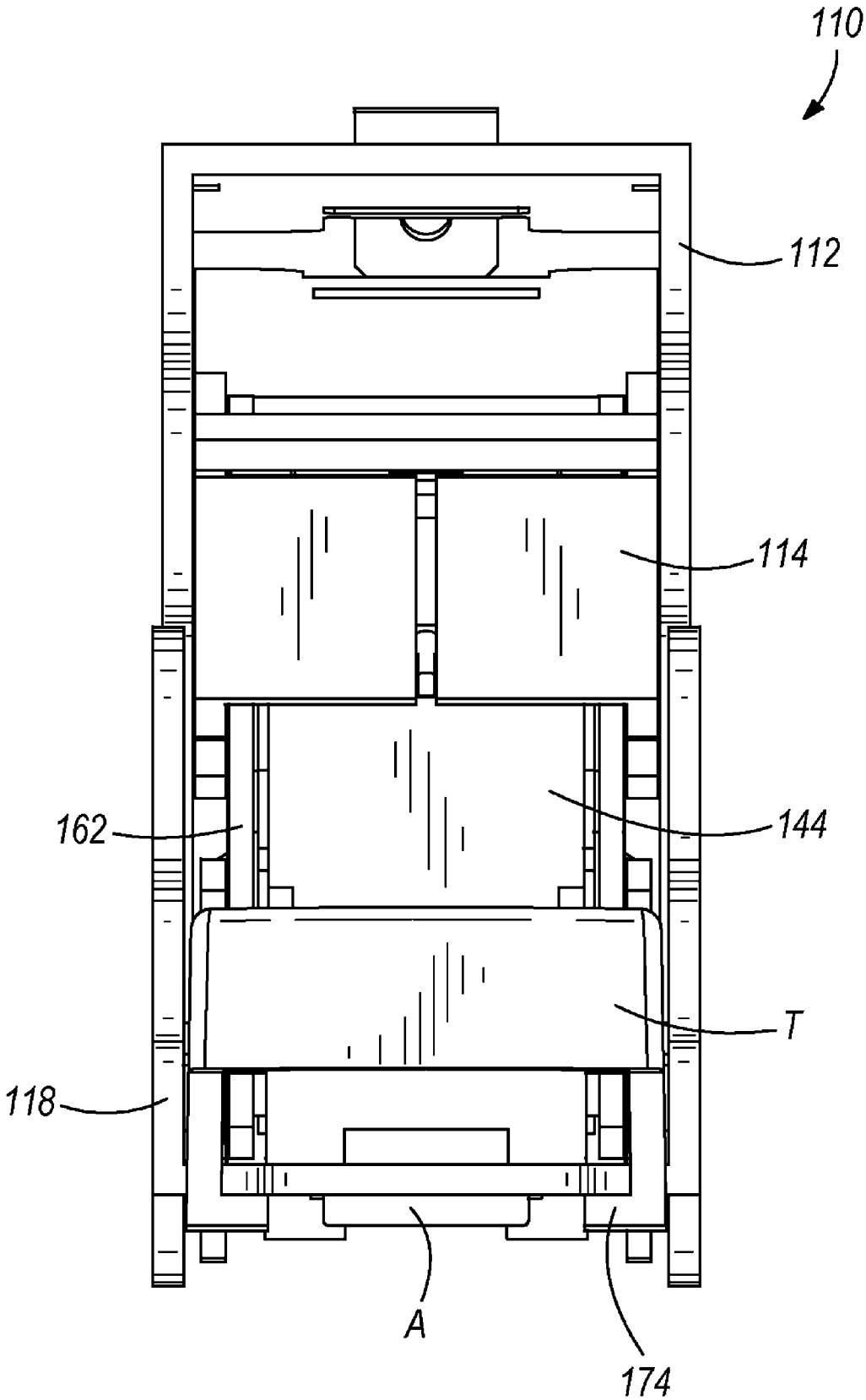
FIG. 5B is a front view of the stapler of FIG. 2 in the second condition.
Figure 5C:
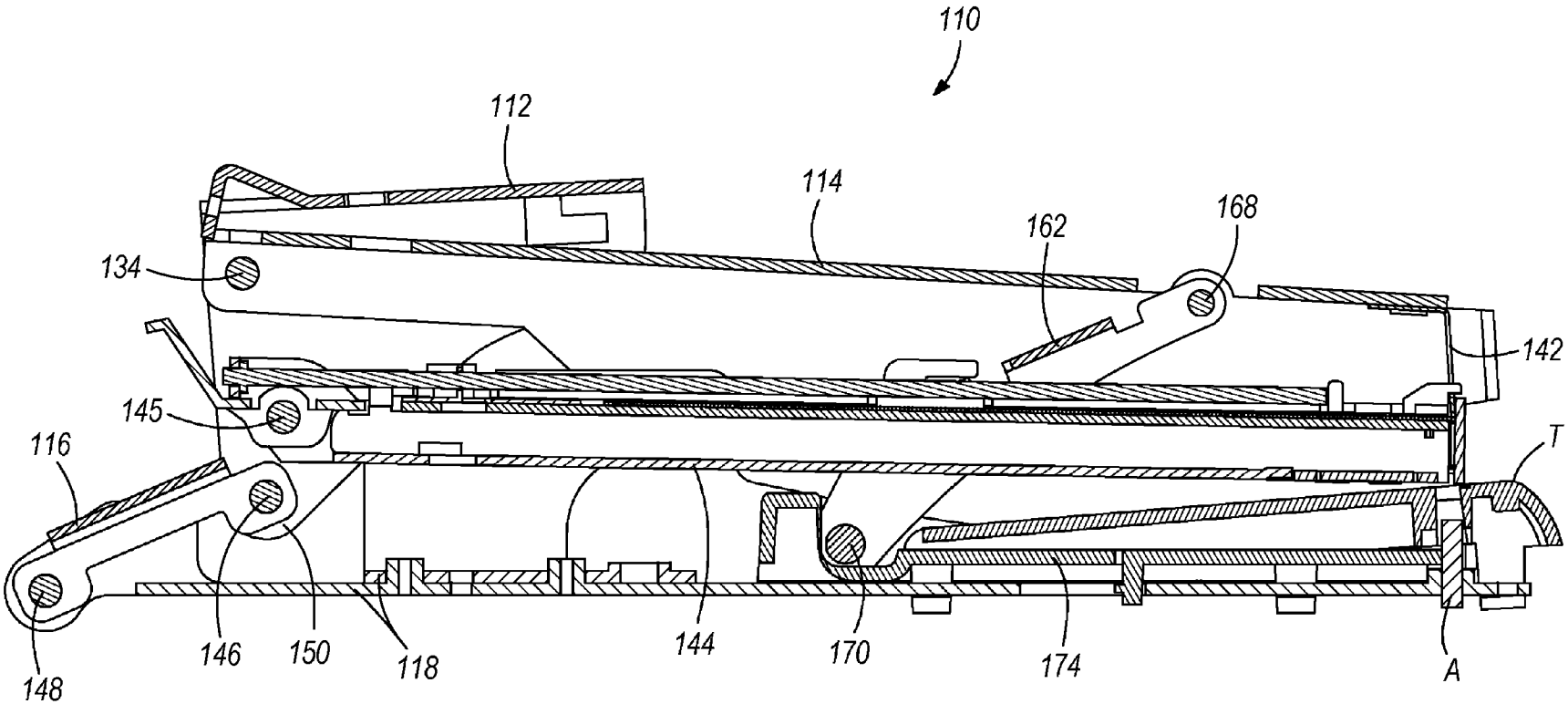
FIG. 5C is a cross-sectional view of the stapler of FIG. 2 in the second condition.
Figure 6A:
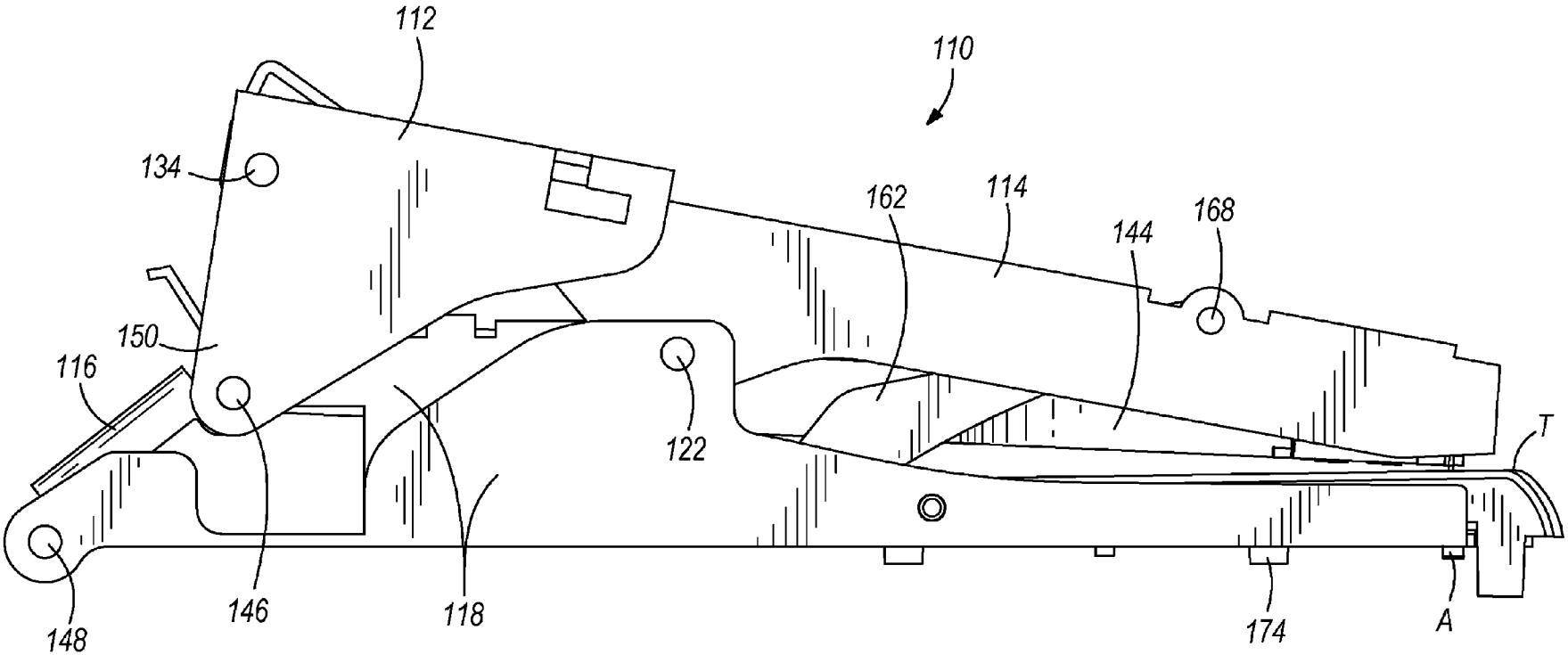
FIG. 6A is a side view of the stapler of FIG. 2 in a third condition.
Figure 6B:
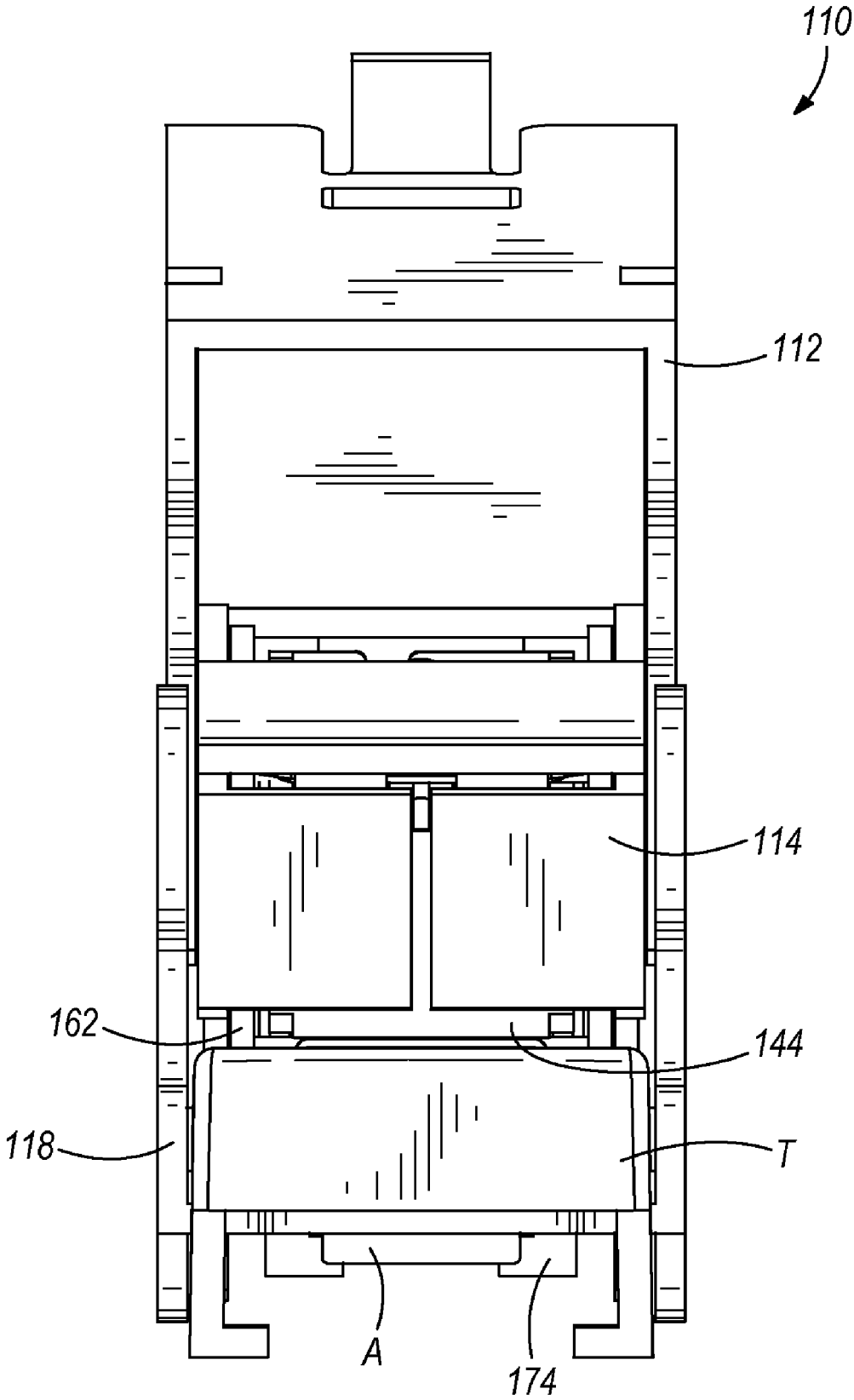
FIG. 6B is a front view of the stapler of FIG. 2 in the third condition.
Figure 6C:
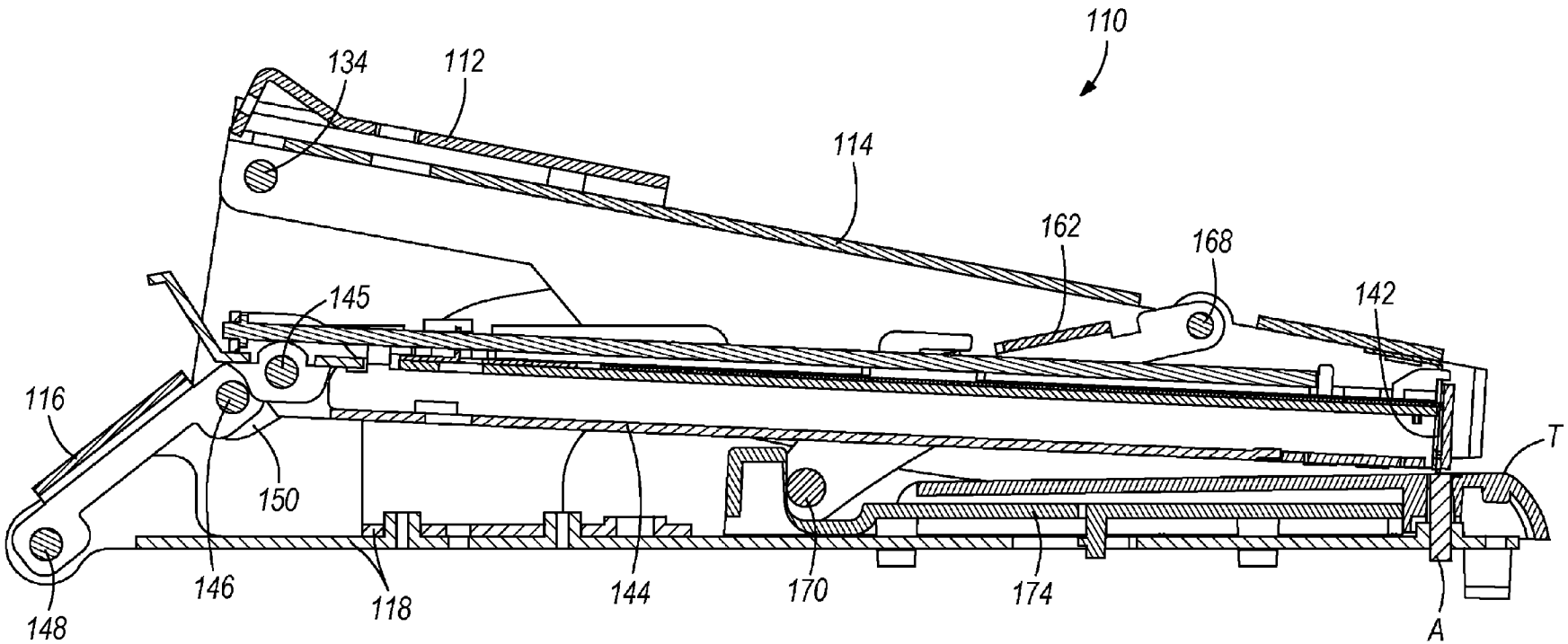
FIG. 6C is a cross-sectional view of the stapler of FIG. 2 in the third condition.

A cover 130 of the stapler 110 is operatively coupled to (e.g., fixed with) the input member 112 to act as an extension (i.e., a handle or input portion) thereof. The cover 130 is configured to directly receive an input force, for example, from a person's hand. In the illustrated construction, the cover 130 extends generally to a second or front end 132 of the stapler 110 having a paper insertion opening. Furthermore, the input member 112 and the drive member 114 are pivotally coupled with a pin 134 at a location along the drive member 114 that is rearward of the drive member's fixed pivot axis 124. Movement of the drive member 114 is configured to drive a staple S from a staple magazine 144 as described in further detail below. The staple magazine 144 is pivotally coupled to the base member 118 with a pin 145 (FIGS. 4C, 5C, 6C). In the illustrated construction, the stapler 110 is configured to flat-clinch staples S with a flat anvil block A. A pivoting support surface or "table" T is selectively pivotable relative to the base member 118 to enable contact between a staple S and the anvil block A for clinching.

The input member 112 is coupled to the base member 118 indirectly through the auxiliary member 116 such that the input member 112 does not have a fixed pivot axis relative to the base member 118. Rather, the input member 112, and more particularly a connecting portion 150 of the input member 112, is coupled to the auxiliary member 116 with a pin 146 to define a third pivot axis 136 that is movable relative to the base member 118 as the auxiliary member 116 pivots relative to the base member 118. The auxiliary member 116 is coupled directly to the base member 118 with a pin 148 defining a fixed pivot axis 138 relative to the base member 118. The movable pivot axis 136 of the input member 112 travels along an arcuate path P (FIG. 4C) centered about the auxiliary member's fixed pivot axis 138 at the pin 148. The radius of the arcuate path P is the distance between the centers of the two pins 146, 148.

In the illustrated embodiment, the fixed pivot axis 138 of the auxiliary member 116 is positioned substantially at the rear end 126 of the stapler 110, rearward of the drive member's fixed pivot axis 124 and rearward of the joint between the auxiliary member 116 and the input member 112 (i.e., the pivot axis 136). The auxiliary member 116 extends from its fixed pivot axis 138 in a direction generally away from the rear end 126 of the stapler 110 and towards the front end 132.

As shown in FIGS. 4C, 5C, and 6C, the drive member 114 includes a driver blade 142 that contacts the staple S during actuation of the stapler 110 to drive the staple S from the staple magazine 144 to complete the stapling operation. The stapler 110 staples 20 sheets with a force on the input member 112 of less than about 9 pounds (e.g., between about 7 pounds and about 8 pounds).

A secondary driver arm 162 is coupled to the drive member 114 with a pin 168 and operable to pivot the magazine 114 relative to the base member 118 downward about an axis defined by the pin 145. A lower end 170 of the secondary driver arm 162 actuates a latch member 174 that is operable to selectively enable the table T to pivot or "drop" relative to the base member 118. Rearward translation of the latch member 174 allows the table T to drop as shown in FIG. 6C.

Figure 4A:
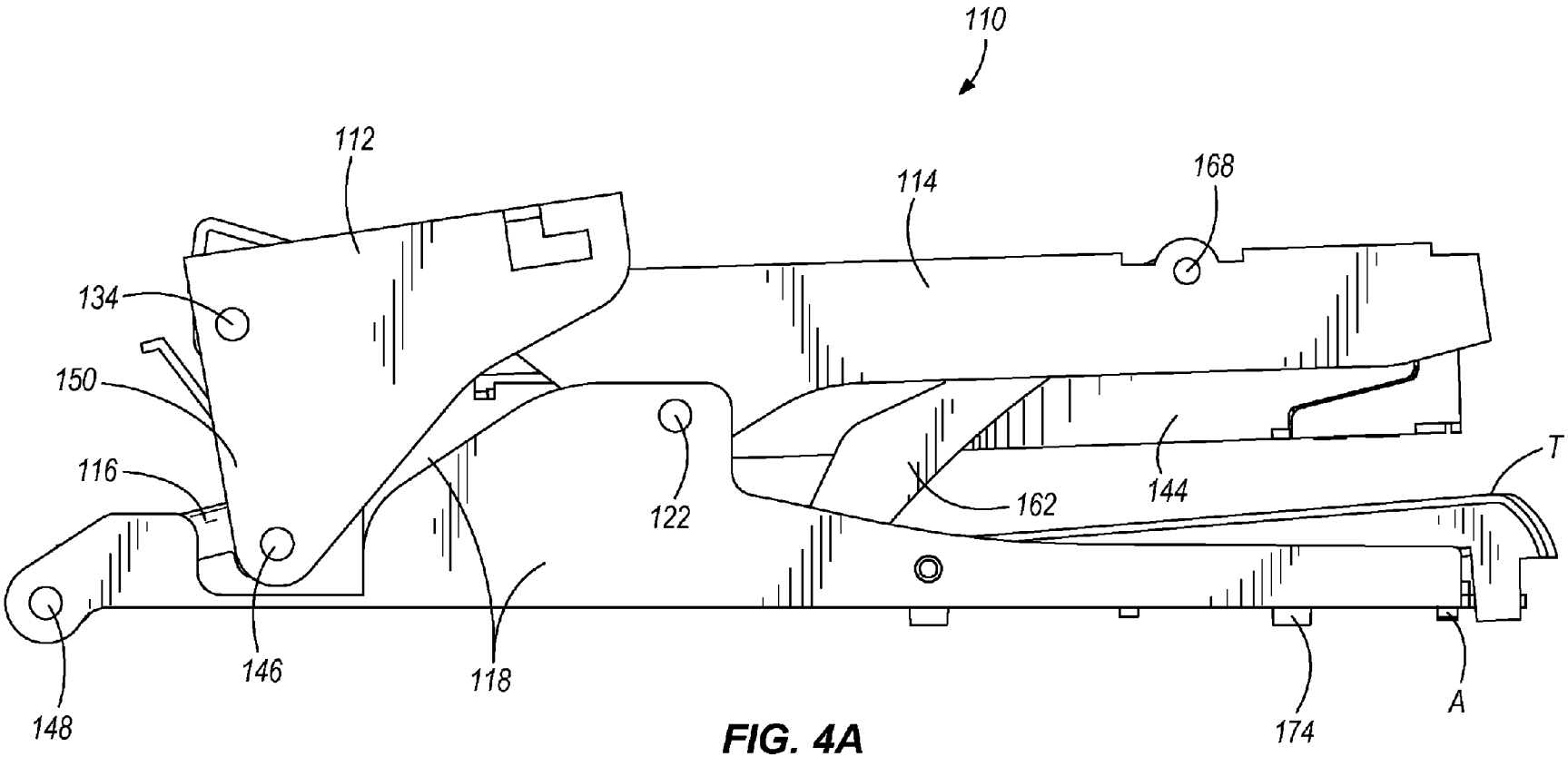
FIG. 4A is a side view of the stapler of FIG. 2 in a first condition.
Figure 4B:
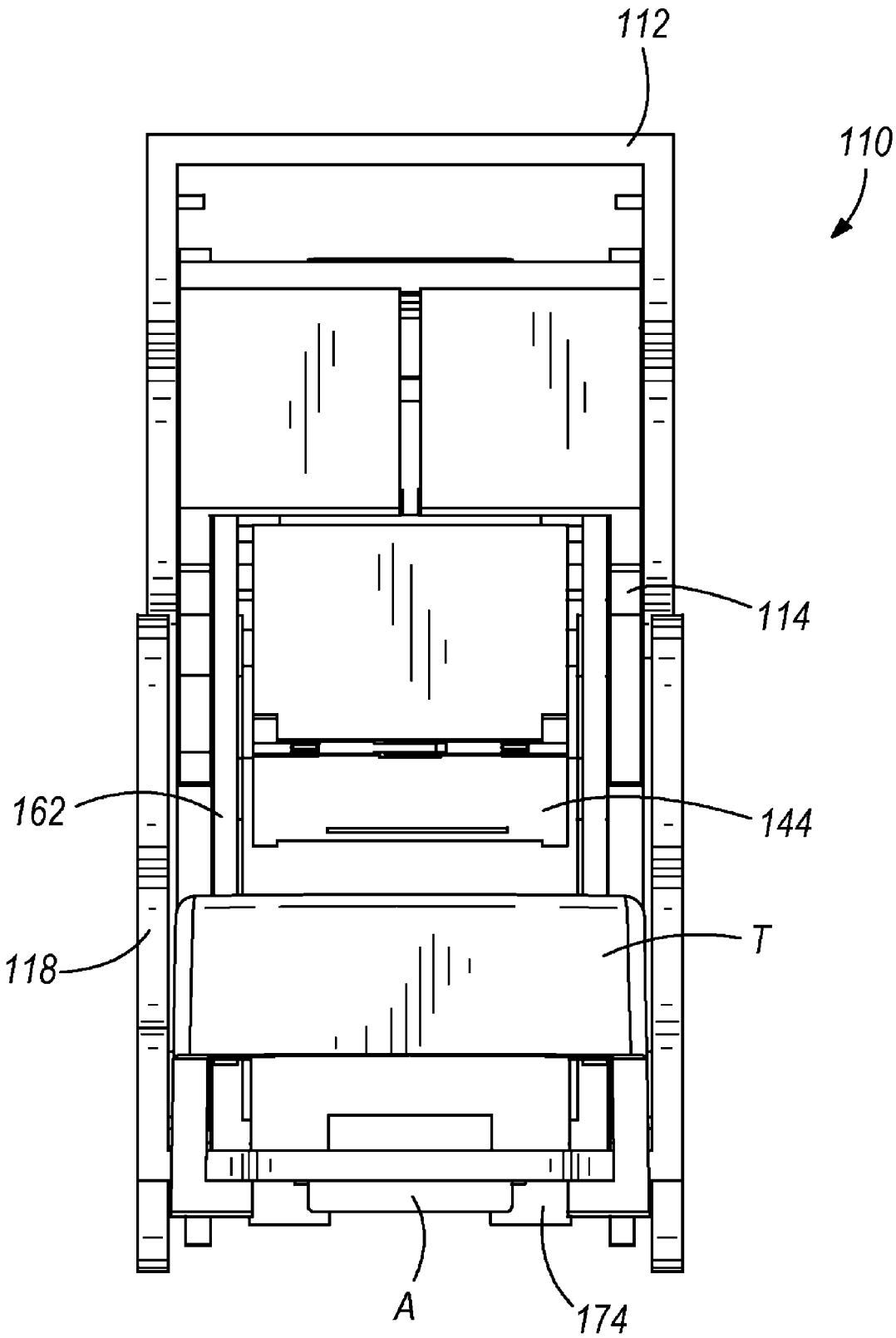
FIG. 4B is a front view of the stapler of FIG. 2 in the first condition.

FIG. 4A is a side view of the stapler 110 in a first condition, which is a non-actuated or "rest" condition. FIG. 5A is a side view of the stapler 110 in a second condition, which is a partially-actuated condition. FIG. 6A is a side view of the stapler 110 in a third condition, which is a fully-actuated condition. As shown in the section view of FIG. 5C, the secondary driver arm 162 and the staple magazine 144 are driven downward by the drive member 114 (via the pin 168) when the stapler 110 is actuated, the magazine rotating about the pin 145.

FIGS. 7-11C illustrates a stapler 210 according to a second embodiment having a drive arrangement consistent with the linkage of FIG. 1. Insofar as the stapler 210 is similar to the stapler 110, of FIGS. 2-6C described above, reference numbers in FIGS. 7-11C are similar to those of the previous embodiment where similarity permits, with the exception of being taken from the 200 series.

The drive arrangement of the stapler 210 of FIGS. 7-11C is a virtual four-bar linkage consistent with the linkage of FIG. 1. The stapler 210, and more specifically the drive arrangement thereof, includes an input member 212, a drive member 214, and a fixed base member 218. The drive member 214 is coupled to the base member 218 at a first pin 222 defining a pivot axis 224 that is fixed relative to the base member 218. The pivot axis 224 of the drive member 214 is located substantially forward of a first or rear end 226 of the stapler 210. Furthermore, the input member 212 and the drive member 214 are pivotally coupled at a second pin joint 234 at a location along the drive member 214 that is rearward of the first pin joint 222. Movement of the drive member 214, and the driver blade 242 coupled thereto, is configured to drive a staple from the staple magazine 244. The drive member 214 extends forwardly of the input member 212, which is concave on its lower side to partially receive the drive member 214 during actuation of the stapler 210. The stapler 210 includes a cover (not shown), similar to the cover 130 of the stapler 110, immovably coupled to the input member 212 and extending generally to a second or front end 232 of the stapler 210. The cover is configured as a handle or input portion of the input member 212 to directly receive an input force, for example, from a person's hand.

Figure 7:
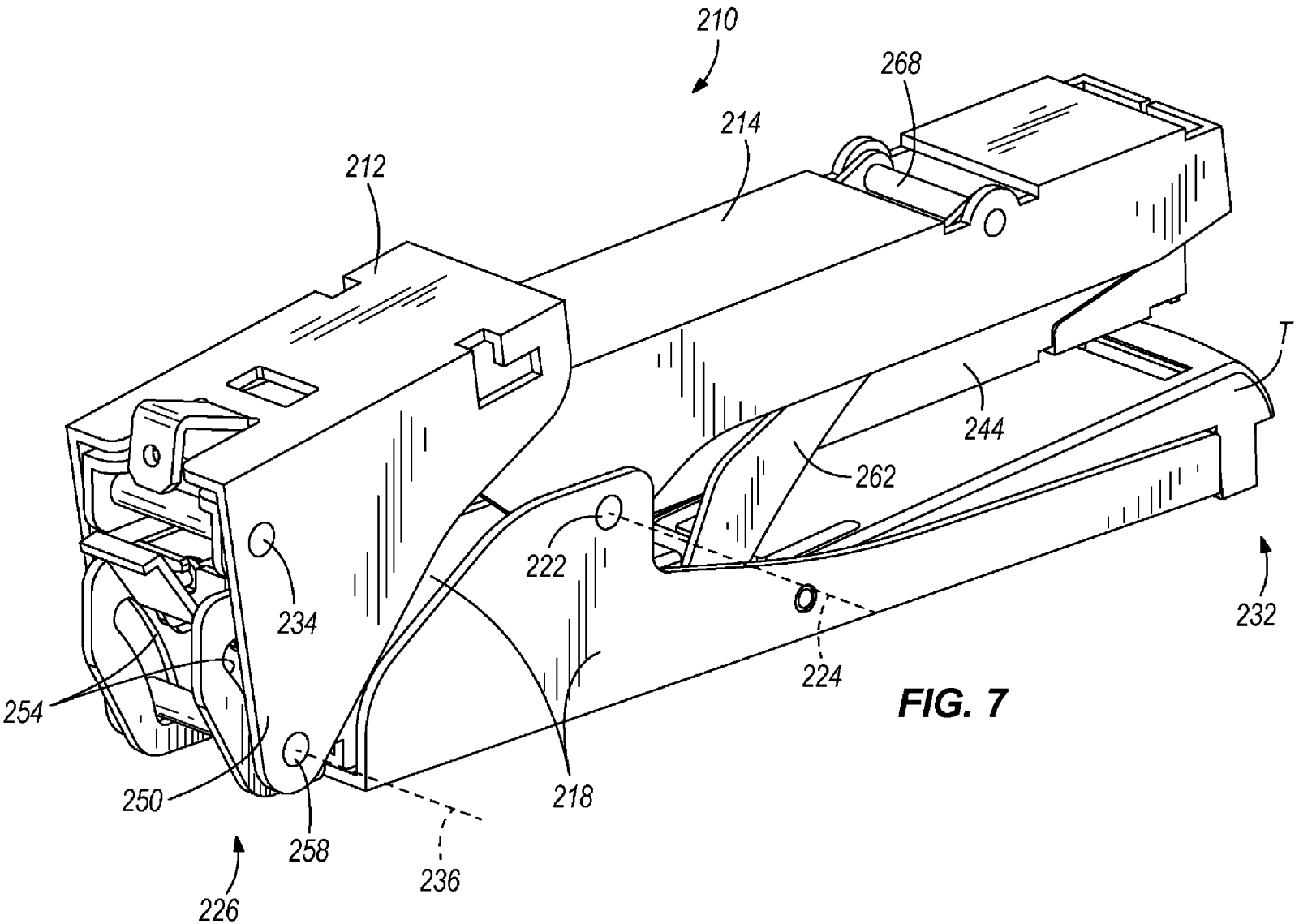
FIG. 7 is a perspective view of a stapler according to a second embodiment, having a drive arrangement consistent with the linkage of FIG. 1
Figure 8:
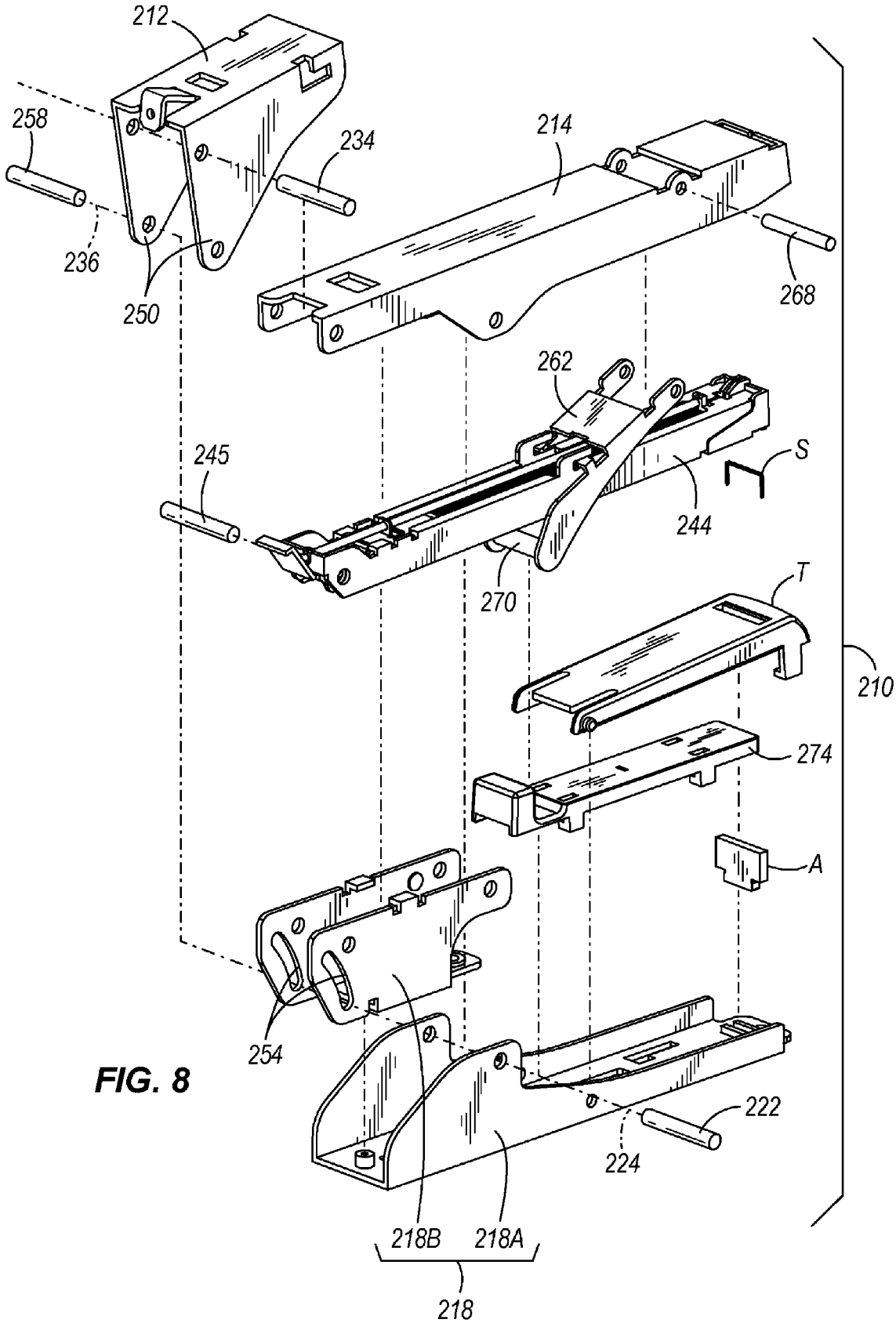
FIG. 8 is an exploded assembly view of the stapler of FIG. 7.

Although the drive arrangement of the stapler 210 does not physically include a separate auxiliary member between the input member 212 and the base member 218, the operation of the drive arrangement is as if there was an auxiliary member because the input member 212 is coupled to the base member 218 at a non-fixed pivot axis 236. For example, as shown in FIG. 7, a connecting portion 250 of the input member 212 is coupled to a slot 254 in the base member 218 with a pin 258. The slot 254 in the base member 218 is arcuate such that the pin 258 moves along an arcuate path P (FIG. 9A) having a radius R and center O during operation of the drive arrangement of the stapler 210. Thus, the pivot axis 236 is movable relative to the base member 218 just as if it were coupled to the base member 218 via an auxiliary member (see arcuate path P in FIG. 4C).

As shown in FIGS. 2-6C and 7-11C, a pin and slot arrangement is interchangeable with an auxiliary member without effect to the operation of the four-bar linkage drive arrangement as both are effective means by which the pivot axis 236 of the input member 212 can be made movable relative to the base member 218 along the arcuate path P. Either one of a pin and slot arrangement and an auxiliary member is effective as a constraint structure to define the allowable path of movement of the pivot axis 236. Either one of a pin and slot arrangement and an auxiliary member is also effective as a support structure against which the input member 212 is able to bear in order to transmit a high force to the drive member 214. The stapler 210 staples 20 sheets with a force on the input member 212 of less than about 9 pounds (e.g., between about 7 pounds and about 8 pounds).

Figure 10A:
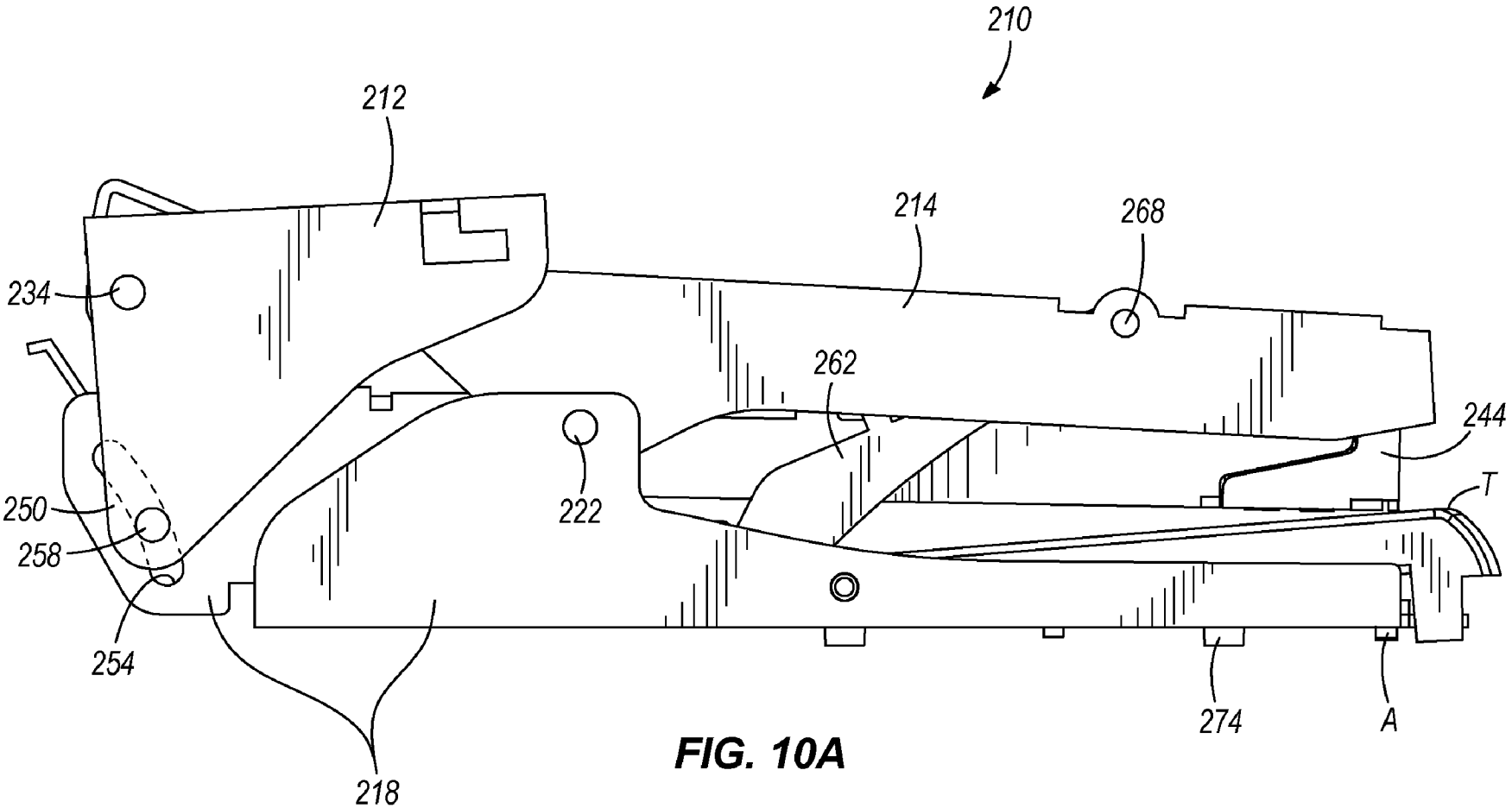
FIG. 10A is a side view of the stapler of FIG. 7 in a second condition.
Figure 11A:
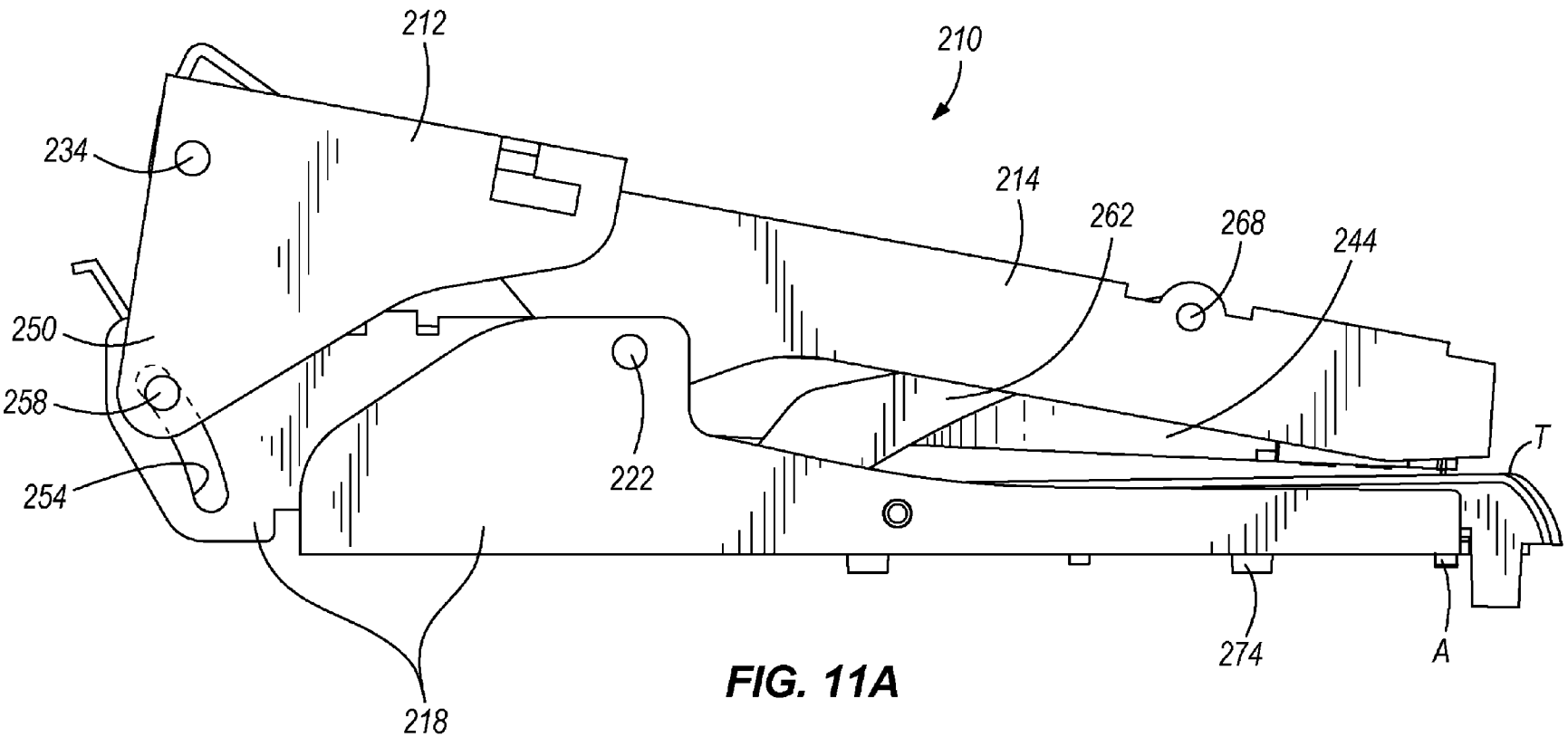
FIG. 11A is a side view of the stapler of FIG. 7 in a third condition.

Furthermore, the slot 254 and the pin 258 may be reversed without affecting the operation of the drive arrangement. In such instances, the pin 258 is fixed with the base member 218, the slot 254 is formed in the connecting portion 250 of the input member 212, and movement of the input member 212 is guided by the pin 258 in the same way as illustrated in FIGS. 9A, 10A, and 11A.

Figure 9A:
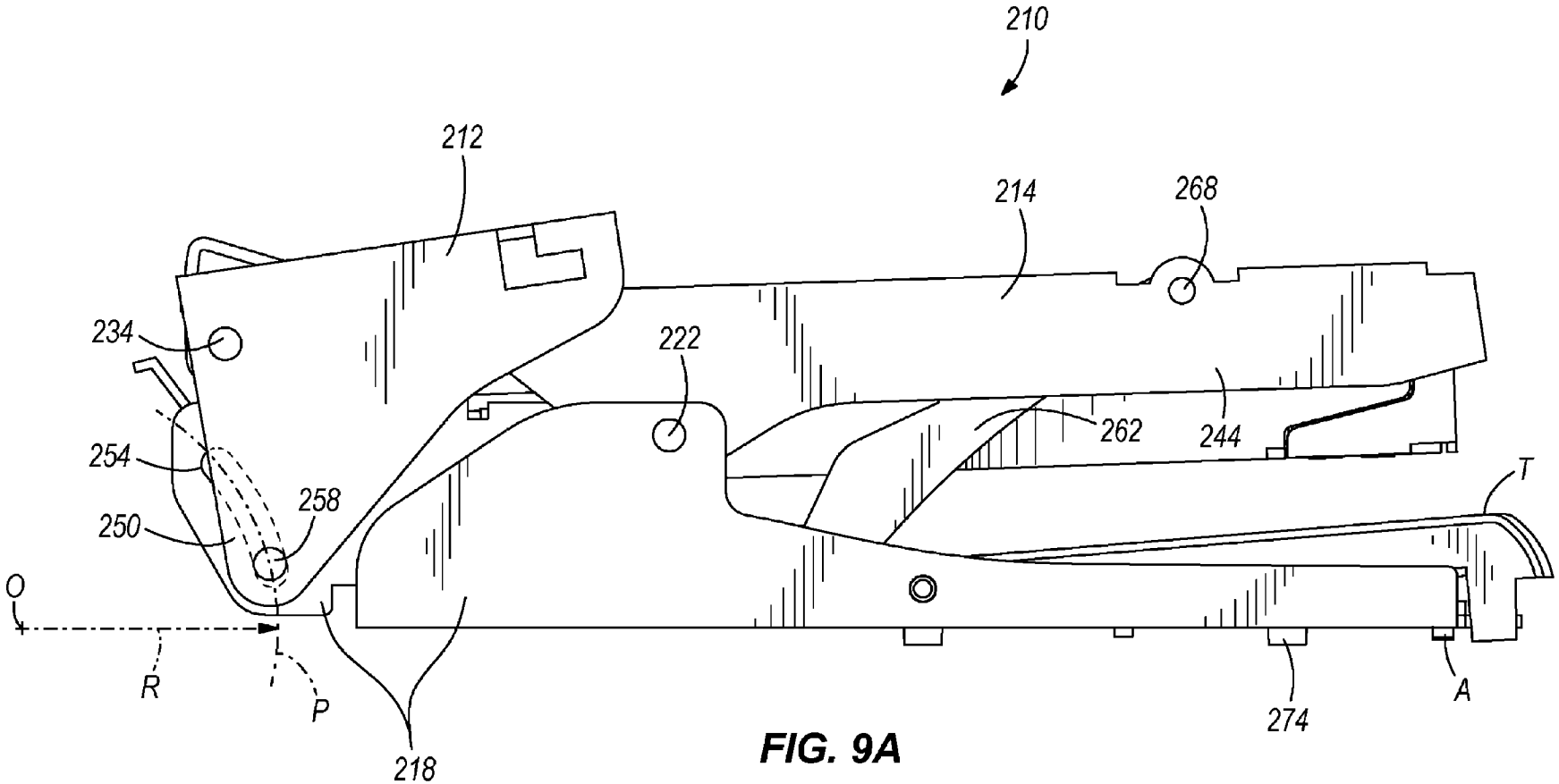
FIG. 9A is a side view of the stapler of FIG. 7 in a first condition.
Figure 9B:
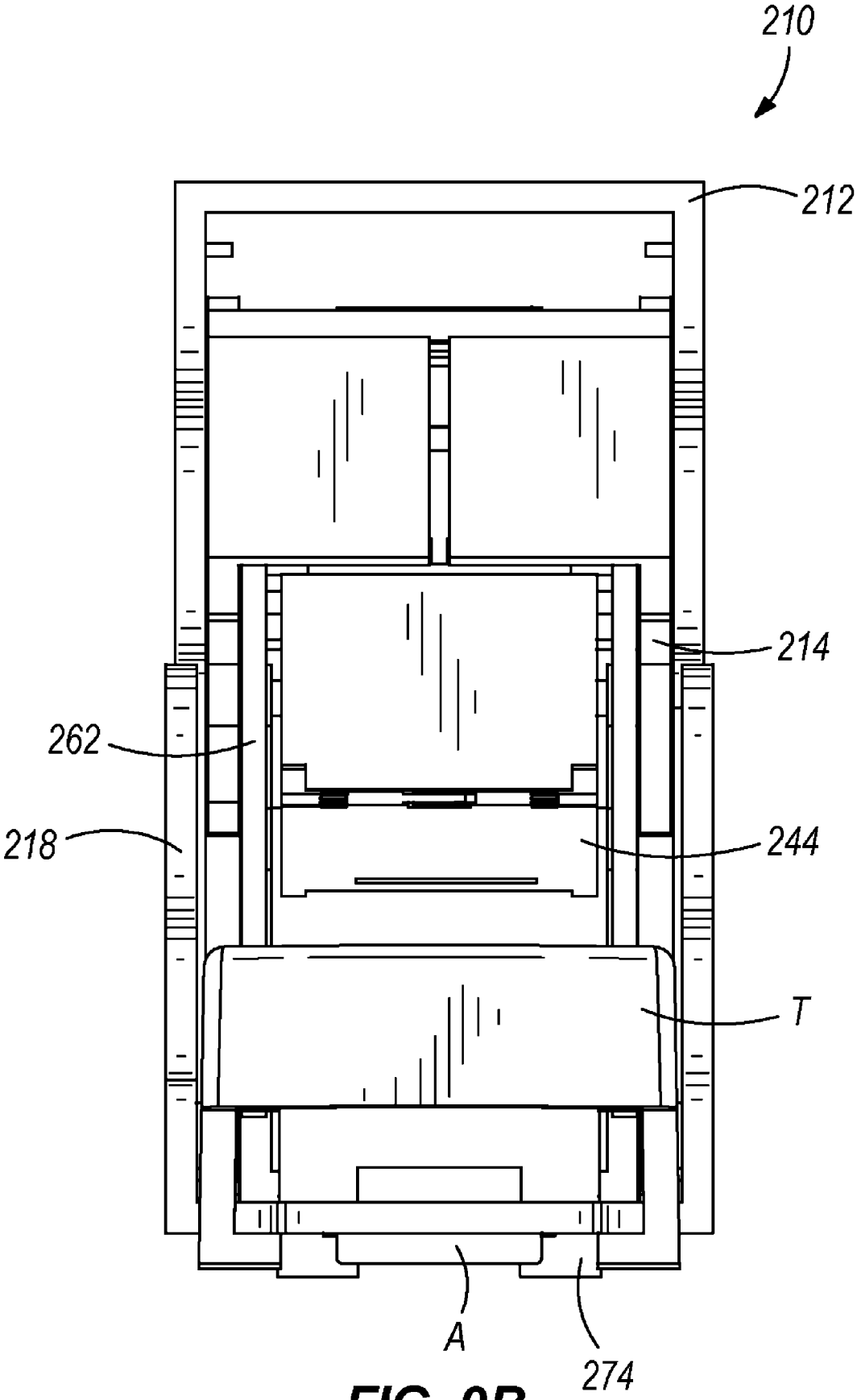
FIG. 9B is a front view of the stapler of FIG. 7 in the first condition.
Figure 9C:
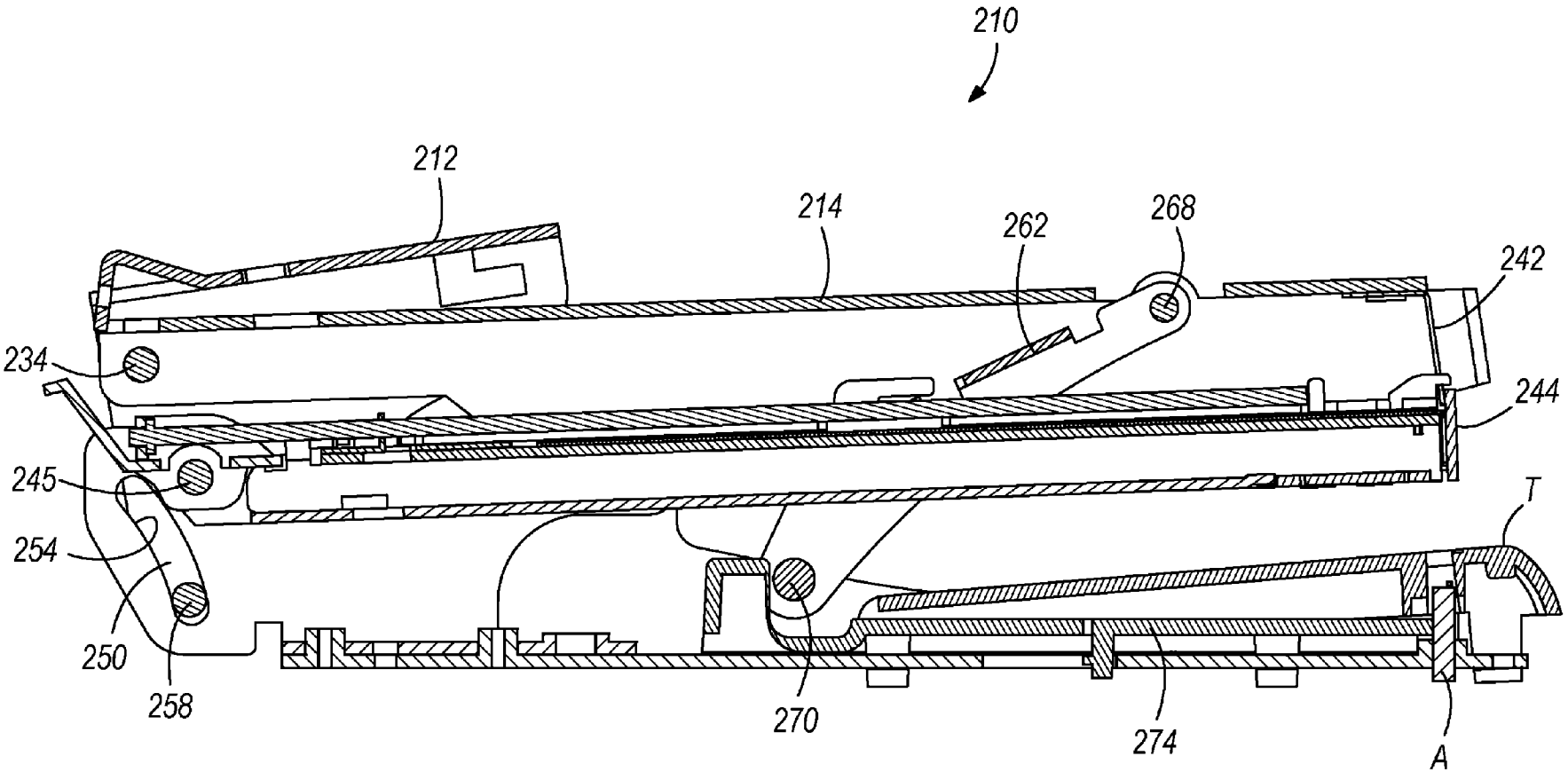
FIG. 9C is a cross-sectional view of the stapler of FIG. 7 in the first condition.
Figure 10B:
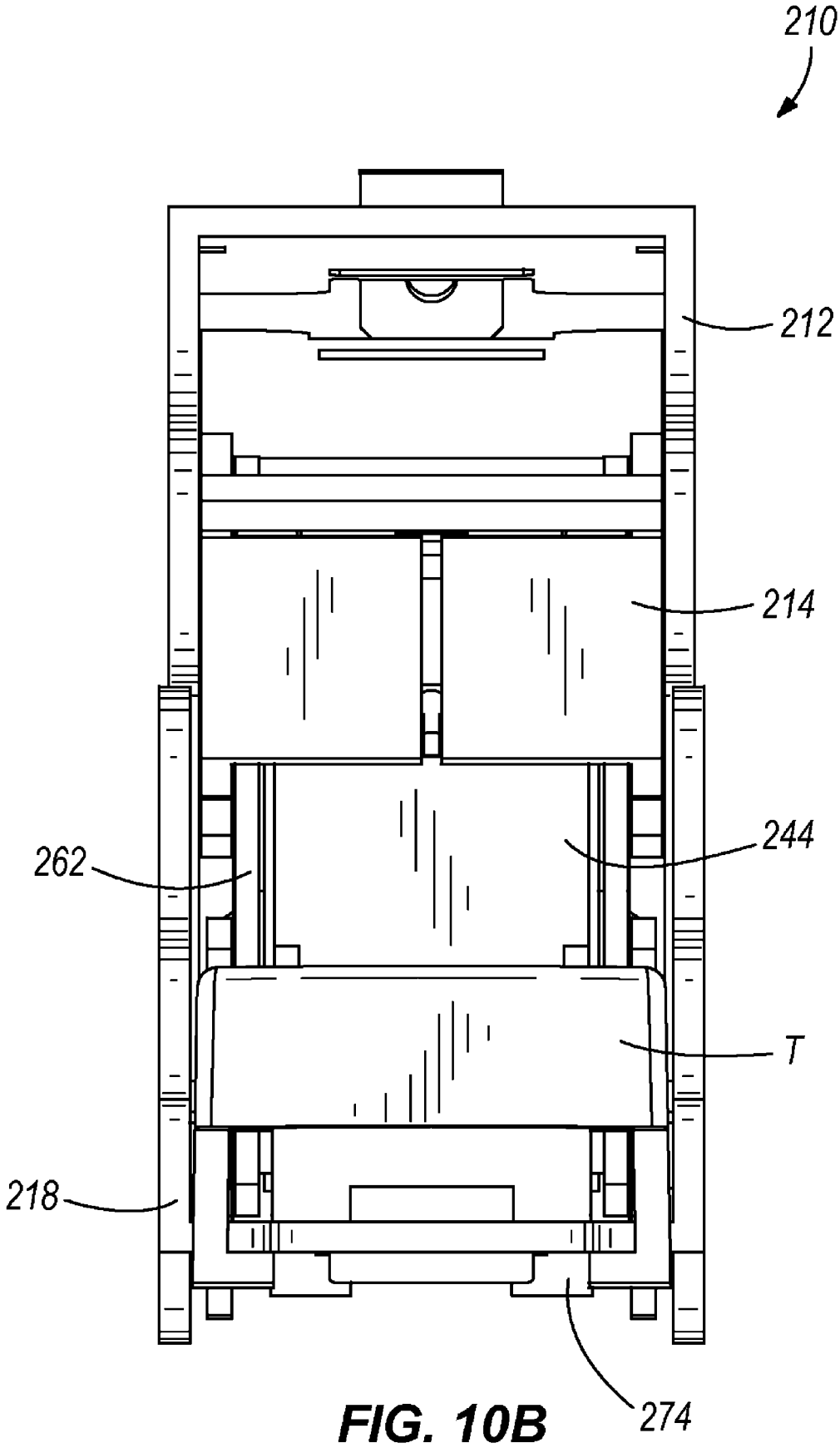
FIG. 10B is a front view of the stapler of FIG. 7 in the second condition.
Figure 10C:
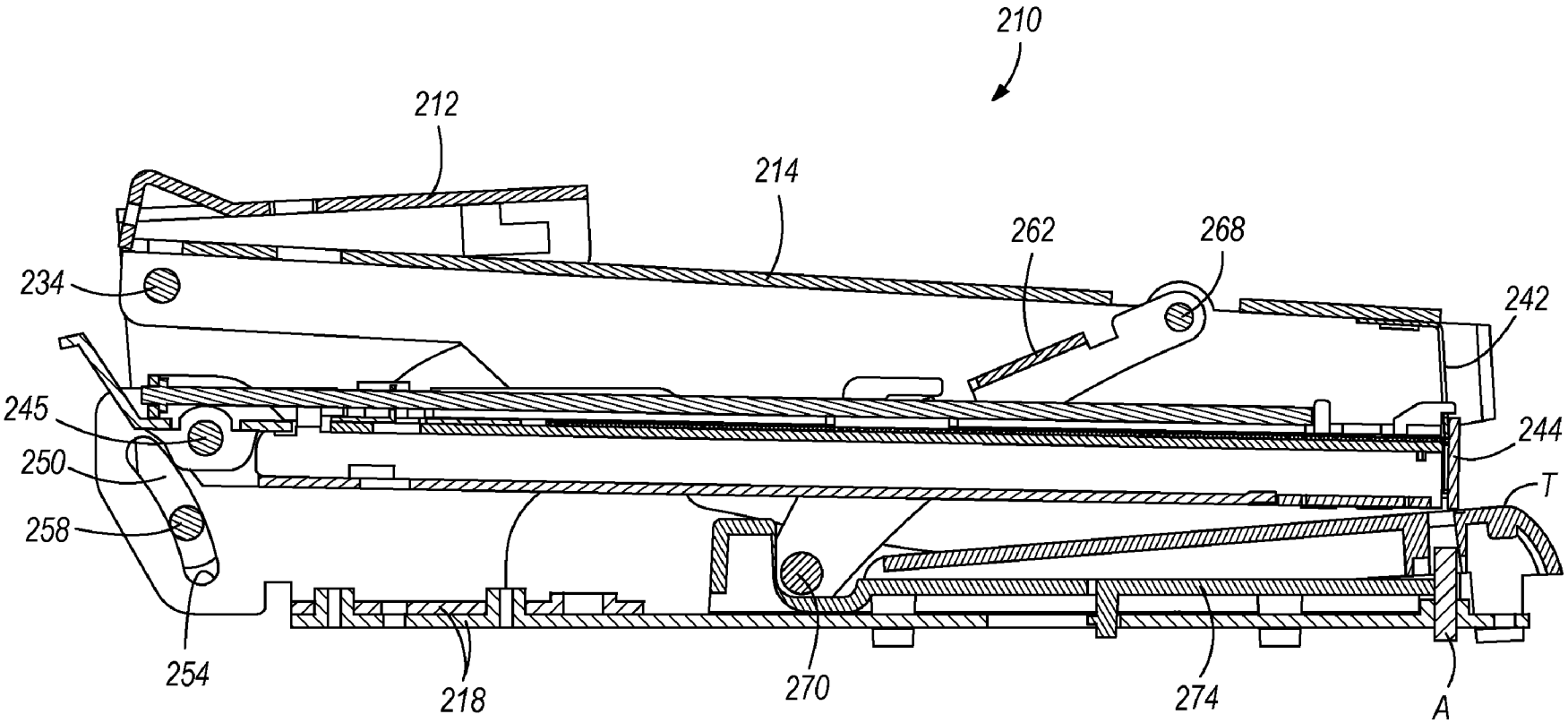
FIG. 10C is a cross-sectional view of the stapler of FIG. 7 in the second condition.
Figure 11B:
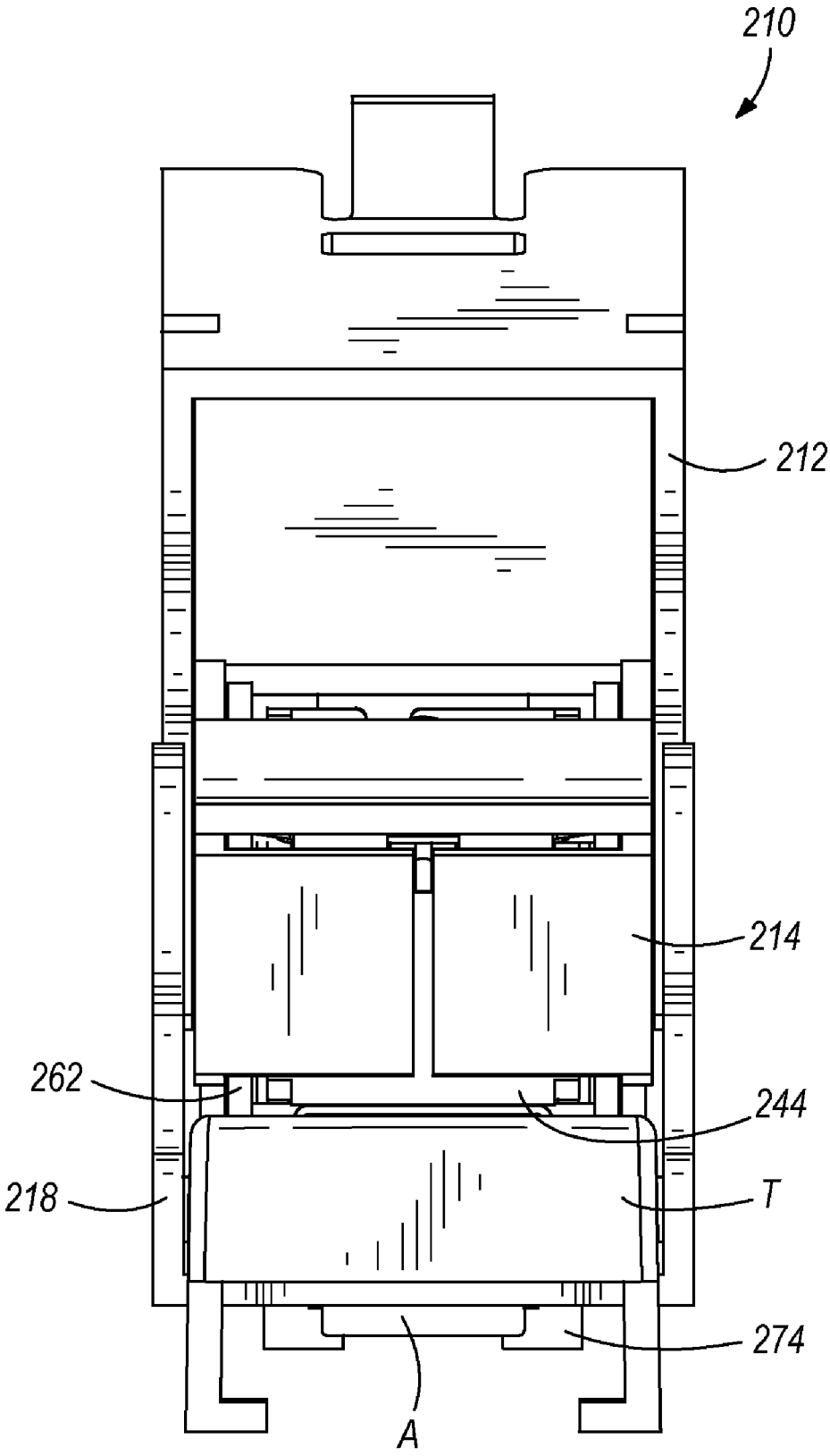
FIG. 11B is a front view of the stapler of FIG. 7 in the third condition.
Figure 11C:
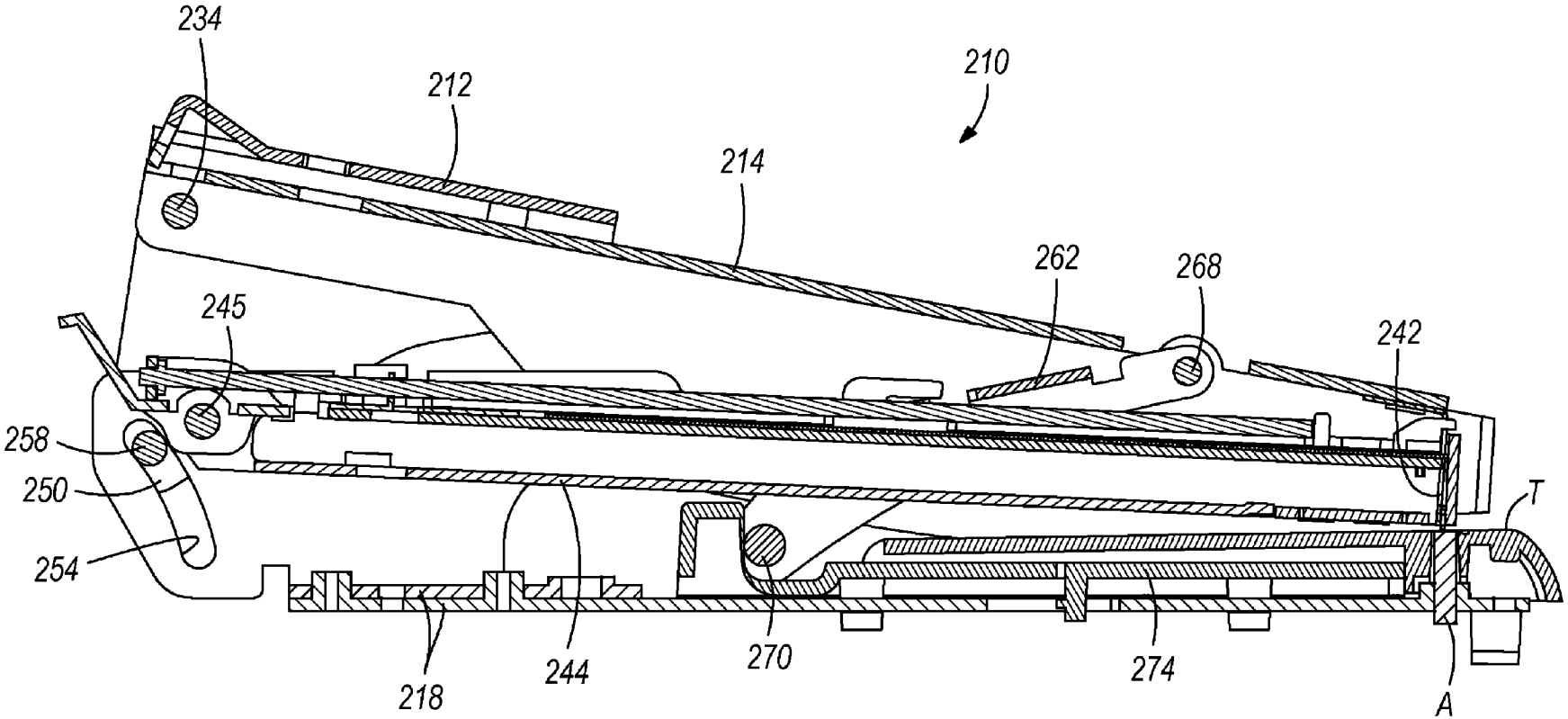
FIG. 11C is a cross-sectional view of the stapler of FIG. 7 in the third condition.

FIGS. 9A-9C illustrate the stapler 210 from the side, from the front, and in cross-section in the non-actuated or "rest" condition. FIGS. 10A-11C are similar to FIGS. 9A-C, with FIGS. 10A-10C illustrating the stapler 210 in a partially-actuated condition, and FIGS. 11A-11C illustrating the stapler 210 in a fully-actuated condition with the staple magazine 244 abutting the base member 218, just prior to the driver blade 242 ejecting a staple from the staple magazine 244. In the non-actuated condition, the forward end of the input member 212 is tilted slightly upward. The pin 258 is near the bottom extent of the arcuate slot 254 in the base member 218, and the drive member 214 is approximately horizontal, having only a slight upward tilt towards the forward end. When the stapler 210 is fully-actuated as shown in FIGS. 11A-11C, the forward end of the input member 212 is tilted downwardly, as is the forward end of the drive member 214. The pin 258 is near the upper extent of the arcuate slot 254 in the base member 218. During actuation (FIGS. 10A-10C) between the non-actuated and fully-actuated conditions, the drive member 214 pivots about the fixed pivot axis 224 (FIG. 7) at the first pin joint 222 while the input member 212 pivots about the movable pivot axis 236, which moves through various intermediate positions along the arcuate path P.

Figure 12:
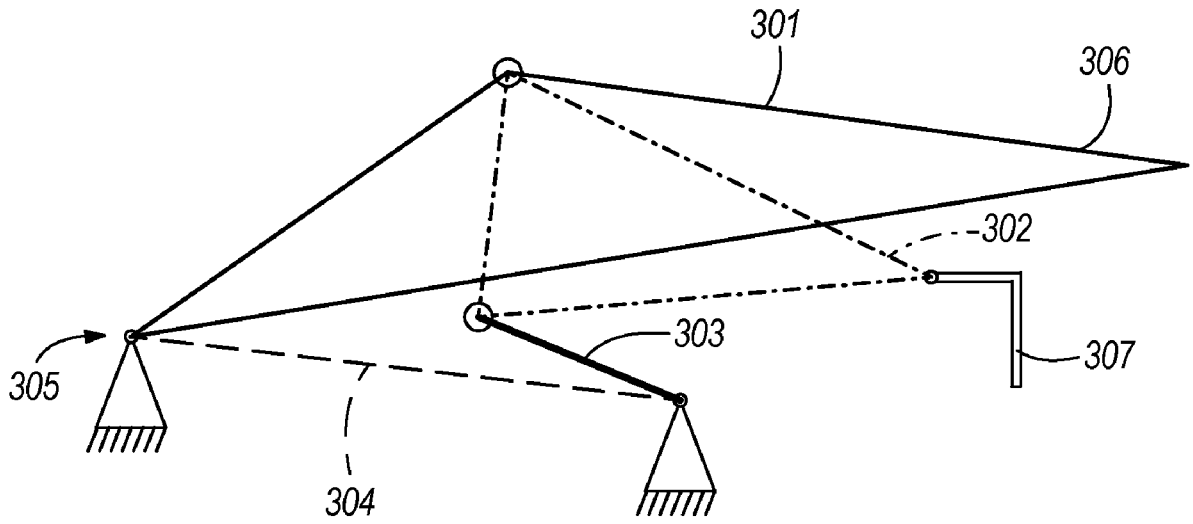
FIGS. 12-16 are schematic views of alternate linkages according to the present invention.

FIG. 12 is a schematic view of a second linkage. The linkage of FIG. 12 is a four-bar linkage drive arrangement for a paper processing tool. The drive arrangement includes an input member 301, a drive member 302, an auxiliary member 303, and a fixed base member 304. The input member 301 is pivotally coupled to the base member 304 at a first or rear end 305 of the drive arrangement and includes a handle 306 at a second or front end of the drive arrangement. The input member 301 and the drive member 302 are pivotally coupled at a location on the input member 301 between the handle 306 and the fixed pivot at which the input member 301 is coupled to the base member 304. The pivotal coupling between the input member 301 and the drive member 302 is located rearward of a driver blade 307 coupled to a forward end of the drive member 302. The drive member 302 is coupled to the base member 304 through the auxiliary member 303 such that the drive member 302 does not have a fixed pivot axis relative to the base member 304. Rather, the pivot axis of the drive member 302 relative to the base member 304 moves along an arcuate path defined by the auxiliary member 303. The auxiliary member 303 is coupled directly to the base member 304 and has a fixed pivot axis on the base member 304, the end of the auxiliary member 303 opposite its fixed pivot defining the arcuate path.

As shown in FIG. 12, the pivot axis of the auxiliary member 303 on the base member 304 is positioned forward of the fixed pivot of the input member 301, and the auxiliary member 303 (although movable during operation of the drive arrangement) extends from its fixed pivot in a direction generally towards the rear end 305 of the drive arrangement and away from the front of the drive arrangement. The paper tools 110, 210 of FIGS. 2-6C and 7-11C, and other paper tools not illustrated, can include drive arrangements consistent with the schematic linkage of FIG. 12 rather than that of FIG. 1. A paper tool consistent with the schematic linkage of FIG. 12 can include either the auxiliary member 303 shown or a slot that simulates the presence of the auxiliary member 303 by enabling arcuate movement of the pivot axis of the drive member 302 relative to the base member 304.

Figure 13:
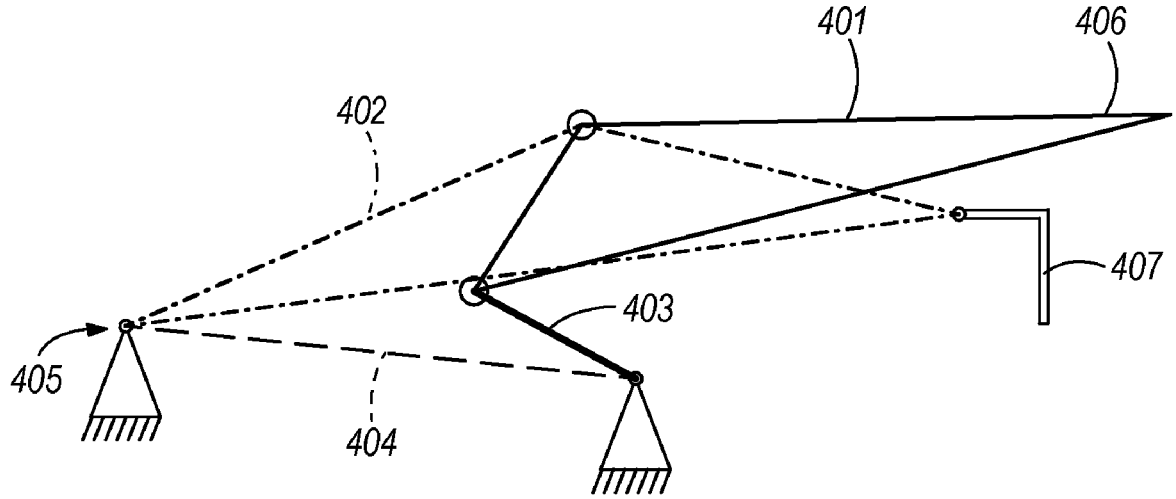

FIG. 13 is a schematic view of a third linkage. The linkage of FIG. 13 is a four-bar linkage drive arrangement for a paper processing tool. The drive arrangement includes an input member 401, a drive member 402, an auxiliary member 403, and a fixed base member 404. The drive member 402 is pivotally coupled to the base member 404 at a first or rear end 405 of the drive arrangement and includes a handle 406 at a second or front end of the drive arrangement. The input member 401 and the drive member 402 are pivotally coupled at a location on the drive member 402 between the driver blade 407 and the point at which the drive member 402 is coupled to the base member 404. The input member 401 is coupled to the base member 404 through the auxiliary member 403 such that the input member 401 does not have a fixed pivot axis relative to the base member 404. Rather, the pivot axis of the input member 401 relative to the base member 404 is movable about an arcuate path defined by the auxiliary member 403. The auxiliary member 403 is coupled directly to the base member 404 and has a fixed pivot axis on the base member 404, the end of the auxiliary member 403 opposite its fixed pivot defining the arcuate path.

As shown in FIG. 13, the fixed pivot axis of the auxiliary member 403 on the base member 404 is positioned forward of the fixed pivot of the drive member 402, and the auxiliary member 403 (although movable during operation of the drive arrangement) extends from its fixed pivot in a direction generally towards the rear end 405 of the drive arrangement and away from the front of the drive arrangement. The paper tools 110, 210 of FIGS. 2-6C and 7-11C, and other paper tools not illustrated, can include drive arrangements consistent with the schematic linkage of FIG. 13 rather than that of FIG. 1. A paper tool consistent with the schematic linkage of FIG. 13 can include either the auxiliary member 403 shown or a slot that simulates the presence of the auxiliary member 403 by enabling arcuate movement of the pivot axis of the input member 401 relative to the base member 404. A stapler having a drive arrangement according to FIG. 13 staples 20 sheets with an input force on the handle 406 of as little as about 3.5 pounds.

Figure 14:
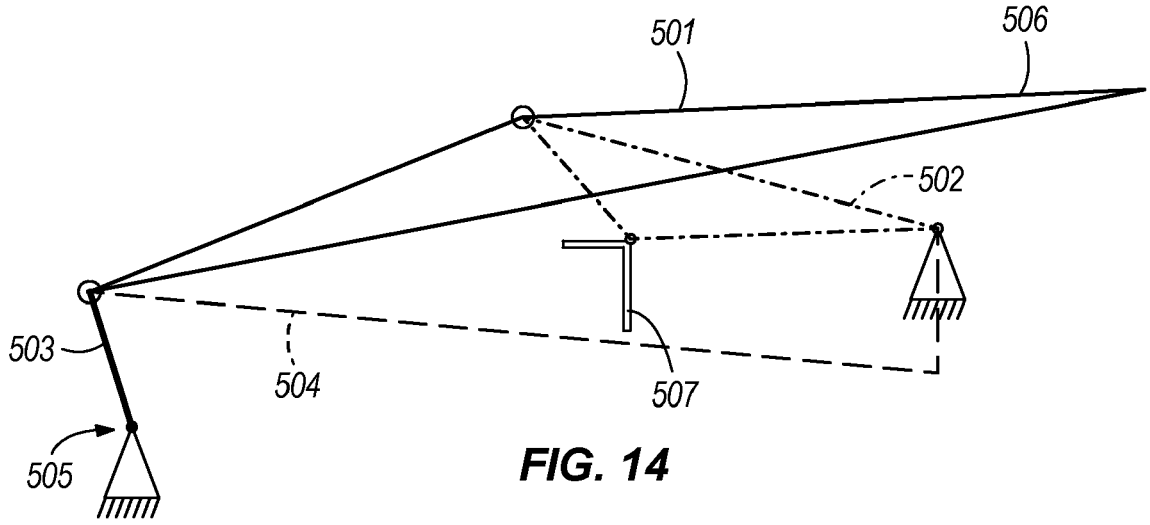

FIG. 14 is a schematic view of a fourth linkage. The linkage of FIG. 14 is a four-bar linkage drive arrangement for a paper processing tool. The drive arrangement includes an input member 501, a drive member 502, an auxiliary member 503, and a fixed base member 504. The drive member 502 is pivotally coupled to the base member 504. The input member 501 and the drive member 502 are pivotally coupled at a location rearward of the point at which the drive member 502 is coupled to the base member 504. The drive member 502 is pivotally coupled to the base member 504 adjacent a forward end of the drive arrangement and forward of the driver blade 507 attached thereto.

The input member 501 is coupled to the base member 504 through the auxiliary member 503 such that the input member 501 does not have a fixed pivot axis relative to the base member 504. Rather, the pivot axis of the input member 501 relative to the base member 504 is movable about an arcuate path defined by the auxiliary member 503. The auxiliary member 503 is coupled directly to the base member 504 adjacent a rear end 505 of the drive arrangement and has a fixed pivot axis on the base member 504, the end of the auxiliary member 503 opposite its fixed pivot defining the arcuate path.

As shown in FIG. 14, the fixed pivot axis of the auxiliary member 503 on the base member 504 is positioned rearward of the fixed pivot of the drive member 502 and forward of the non-fixed pivot axis where the input member 501 is coupled to the auxiliary member 503. The auxiliary member 503 (although movable during operation of the drive arrangement) extends from its fixed pivot in a direction generally away from the front of the drive arrangement where the handle portion 506 is positioned. The paper tools 110, 210 of FIGS. 2-6C and 7-11C, and other paper tools not illustrated, can include drive arrangements consistent with the schematic linkage of FIG. 14 rather than that of FIG. 1. A paper tool consistent with the schematic linkage of FIG. 14 can include either the auxiliary member 503 shown or a slot that simulates the presence of the auxiliary member 503 by enabling arcuate movement of the pivot axis of the input member 501 relative to the base member 504.

Figure 15:
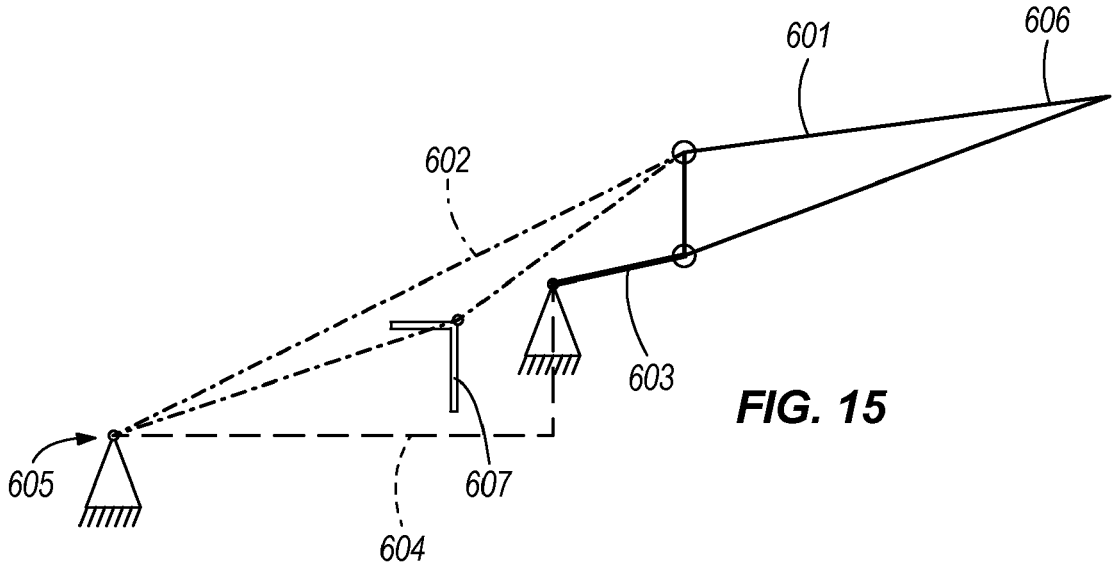

FIG. 15 is a schematic view of a fifth linkage. The linkage of FIG. 15 is a four-bar linkage drive arrangement for a paper processing tool. The drive arrangement includes an input member 601, a drive member 602, an auxiliary member 603, and a fixed base member 604. The drive member 602 is pivotally coupled to the base member 604 adjacent a first or rear end 605 of the drive arrangement. The input member 601 and the drive member 602 are pivotally coupled at a location forward of the fixed pivot of the drive member 602 on the base member 604.

The input member 601 is coupled to the base member 604 through the auxiliary member 603 such that the input member 601 does not have a fixed pivot axis relative to the base member 604. Rather, the pivot axis of the input member 601 relative to the base member 604 is movable along an arcuate path defined by the auxiliary member 603. The auxiliary member 603 is coupled directly to the base member 604 and has a fixed pivot axis on the base member 604, the end of the auxiliary member 603 opposite its fixed pivot defining the arcuate path. The fixed pivot of the auxiliary member 603 is positioned substantially forward of the fixed pivot of the drive member 602. As shown in FIG. 15, the auxiliary member 603 (although movable during operation of the drive arrangement) extends generally forwardly from its fixed pivot axis on the base member 604. Substantially the entire input member 601 extends forwardly beyond the drive member 602 and the auxiliary member 603. The paper tools 110, 210 of FIGS. 2-6C and 7-11C, and other paper tools not illustrated, can include drive arrangements consistent with the schematic linkage of FIG. 15 rather than that of FIG. 1. A paper tool consistent with the schematic linkage of FIG. 15 can include either the auxiliary member 603 shown or a slot that simulates the presence of the auxiliary member 603 by enabling arcuate movement of the pivot axis of the input member 601 relative to the base member 604.

Figure 16:
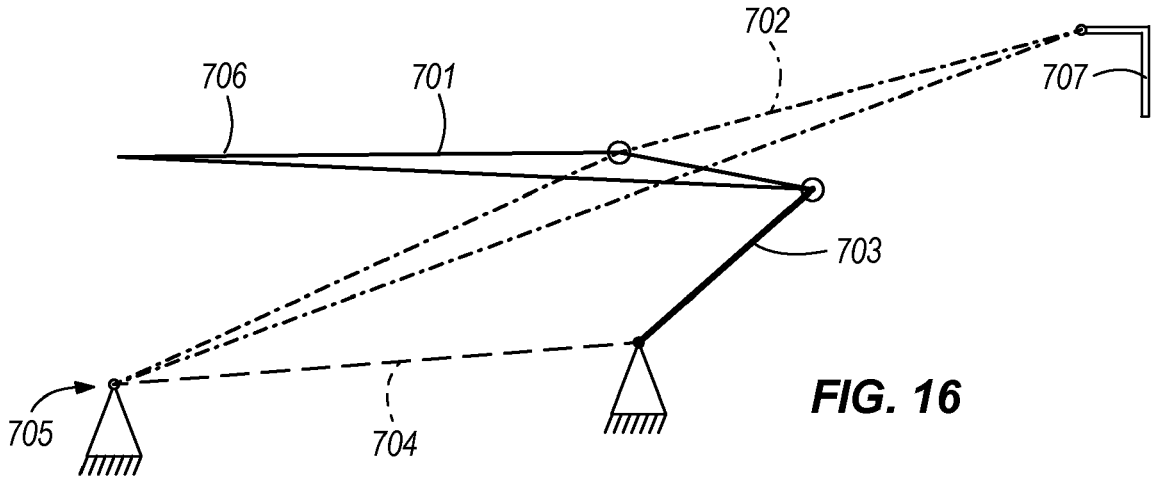

FIG. 16 is a schematic view of a sixth linkage. The linkage of FIG. 16 is a four-bar linkage drive arrangement for a paper processing tool. The drive arrangement includes an input member 701, a drive member 702, an auxiliary member 703, and a fixed base member 704. The drive member 702 is pivotally coupled to the base member 704 adjacent a first or rear end 705 of the drive arrangement. The input member 701 and the drive member 702 are pivotally coupled at a location forward of the point at which the drive member 702 is coupled to the base member 704.

The input member 701 is coupled to the base member 704 through the auxiliary member 703 such that the input member 701 does not have a fixed pivot axis relative to the base member 704. Rather, the pivot axis of the input member 701 relative to the base member 704 is movable along an arcuate path defined by the auxiliary member 703. The auxiliary member 703 is coupled directly to the base member 704 and has a fixed pivot axis on the base member 704, the end of the auxiliary member 703 opposite its fixed pivot defining the arcuate path. The fixed pivot of the auxiliary member 703 is positioned substantially forward of the fixed pivot of the drive member 702. As shown in FIG. 16, the auxiliary member 703 (although movable during operation of the drive arrangement) extends generally forwardly from its fixed pivot axis on the base member 704. The input member 701 extends from the auxiliary member 703 in a direction generally towards the rear end 705 of the drive arrangement, such that the handle portion 706 of the input member 701 is positioned substantially at the rear end 705. The driver blade 707 coupled to the drive member 702 is positioned substantially at a second or forward end of the drive arrangement, opposite the rear end 705. The paper tools 110, 210 of FIGS. 2-6C and 7-11C, and other paper tools not illustrated, can include drive arrangements consistent with the schematic linkage of FIG. 16 rather than that of FIG. 1. A paper tool consistent with the schematic linkage of FIG. 16 can include either the auxiliary member 703 shown or a slot that simulates the presence of the auxiliary member 703 by enabling arcuate movement of the pivot axis of the input member 701 relative to the base member 704.

Thus, the invention provides, among other things, a paper processing tool having a four-bar linkage drive arrangement including an input member, a drive member, and a fixed base member. The drive arrangement further includes an auxiliary member for coupling either the input member or the drive member to the base member such that the one of the drive member and the input member that is pivotably coupled to the auxiliary member is pivotable about a pivot axis that is movable relative to the base member along an arcuate path. Alternatively, an arcuate slot can be used in place of the auxiliary member as means by which the drive member or the input member is pivoted about a pivot axis movable about at arcuate path relative to the base member. Various features and advantages of the invention are set forth in the following claims.

Although the illustrated paper processing tools 110, 210 of FIGS. 2-6C and 7-11C are staplers, the drive arrangements described above and illustrated in the figures are applicable to other types of paper processing tools where a reduction in required input force is beneficial to reduce the effort required to operate the paper processing tool. Such additional types of paper processing tools may include, but are not limited to, punches and trimmers.

What is claimed is:

1. A stapler comprising:

a base member;

a magazine for receiving a plurality of staples;

a drive member including a driver blade movable relative to the magazine for ejecting staples from the magazine one at a time;

an input member pivotally coupled to the drive member, the input member being configured to receive an input force and transmit the input force to the drive member for driving movement of the drive member relative to the magazine; and means for pivoting one of the drive member and the input member about a pivot axis such that the pivot axis moves relative to the base member along an arcuate path.

2. The stapler of claim 1, wherein the input member has a fixed pivot on the base member, and said means is provided between the base member and the drive member.

3. The stapler of claim 1, wherein the drive member has a fixed pivot on the base member, and said means is provided between the base member and the input member.

4. The stapler of claim 1, wherein said means includes an auxiliary member having a fixed pivot on the base member, movement of the auxiliary member about the fixed pivot defining the arcuate path.

5. The stapler of claim 1, wherein said means includes an arcuate slot and a pin arranged in the arcuate slot.

6. The stapler of claim 5, wherein the arcuate slot is formed in the base member.

7. A stapler comprising:

a base member;

a magazine for receiving a plurality of staples;

a drive member including a driver blade movable relative to the magazine for ejecting staples from the magazine one at a time;

an input member pivotally coupled to the drive member, the input member being configured to receive an input force and transmit the input force to the drive member for driving movement of the drive member relative to the magazine; and an auxiliary member pivotally coupled to the base member and to one of the drive member and the input member, the other of the drive member and the input member being pivotally coupled to the base member.

8. The stapler of claim 7, wherein the auxiliary member is pivotally coupled to the drive member.

9. The stapler of claim 8, wherein the auxiliary member has a fixed pivot on the base member, the auxiliary member extending from the fixed pivot generally towards the location where the input member is pivotally coupled to the base member.

10. The stapler of claim 9, wherein the input member is pivotally coupled to the base member adjacent a rear end of the stapler.

11. The stapler of claim 7, wherein the auxiliary member is pivotally coupled to the input member.

12. The stapler of claim 11, wherein the stapler includes a forward end and a rear end, a paper insertion opening of the stapler facing the forward end.

13. The stapler of claim 12, wherein the auxiliary member has a fixed pivot on the base member, the auxiliary member extending from the fixed pivot generally towards the forward end of the stapler.

14. The stapler of claim 13, wherein the fixed pivot of the auxiliary member is positioned forward of a fixed pivot of the drive member on the base member.

15. The stapler of claim 13, wherein the fixed pivot of the auxiliary member is positioned rearward of a fixed pivot of the drive member on the base member.

16. The stapler of claim 13, wherein the auxiliary member is positioned adjacent the rear end of the stapler.

17. The stapler of claim 12, wherein the auxiliary member has a fixed pivot on the base member, the auxiliary member extending from the fixed pivot generally towards the rear end of the stapler.

18. The stapler of claim 17, wherein the auxiliary member is positioned adjacent the rear end of the stapler.

19. A paper tool comprising:

a base member;

a drive member;

an input member pivotally coupled to the drive member; and means for pivoting the drive member about a pivot axis such that the pivot axis moves relative to the base member along an arcuate path.

* * * * *